US011214897B2

(12) United States Patent
Berrian et al.

(10) Patent No.: US 11,214,897 B2
(45) Date of Patent: Jan. 4, 2022

(54) KNITTED CUSHION REGIONS

(71) Applicant: NIKE, Inc., Beaverton, OR (US)

(72) Inventors: Travis J. Berrian, Portland, OR (US); Bryan N. Farris, North Plains, OR (US); Margaret P. St. Clair, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 223 days.

(21) Appl. No.: 16/378,821

(22) Filed: Apr. 9, 2019

(65) Prior Publication Data

US 2019/0313728 A1 Oct. 17, 2019

Related U.S. Application Data

(60) Provisional application No. 62/658,232, filed on Apr. 16, 2018.

(51) Int. Cl.

| | |
|---|---|
| ***D04B 1/24*** | (2006.01) |
| ***A43B 1/04*** | (2006.01) |
| ***A43B 23/04*** | (2006.01) |
| ***A43B 23/02*** | (2006.01) |
| ***D04B 1/10*** | (2006.01) |

(52) U.S. Cl.

CPC ..... *D04B 1/24* (2013.01); *A43B 1/04* (2013.01); *A43B 23/0245* (2013.01); *A43B 23/042* (2013.01); *D04B 1/102* (2013.01); *D10B 2501/043* (2013.01)

(58) Field of Classification Search

CPC ... D04B 1/22; D04B 1/24; D04B 1/16; D04B 1/102; D04B 7/28; D04B 9/38; A43B 1/04; A43B 23/0245; A43B 23/042

See application file for complete search history.

(56) References Cited

U.S. PATENT DOCUMENTS

| | | | | |
|---|---|---|---|---|
| 5,319,869 | A | 6/1994 | McDonald et al. | |
| 5,603,232 | A * | 2/1997 | Throneburg | A41B 11/02 2/239 |
| 6,298,582 | B1 | 10/2001 | Friton et al. | |
| 7,793,434 | B2 * | 9/2010 | Sokolowski | A43B 23/0235 36/45 |
| 8,302,329 | B2 | 11/2012 | Hurd et al. | |

(Continued)

FOREIGN PATENT DOCUMENTS

| | | | |
|---|---|---|---|
| CN | 103561605 | A | 2/2014 |
| CN | 204763686 | U | 11/2015 |

(Continued)

OTHER PUBLICATIONS

International Search Report and Written Opinion in International Application No. PCT/US2019/025206, dated Aug. 9, 2019, 16 pages.

*Primary Examiner* — Danny Worrell

(74) *Attorney, Agent, or Firm* — Shook, Hardy & Bacon, LLP

(57) ABSTRACT

An upper may include a knitted component having a first surface and a second surface. The knitted component may include at least one integrally knitted cushion region located on the second surface. The cushion region may include a plurality of non-planar structures that project away from the second surface of the knitted component by at least 1 mm, and the cushion region may be located in a rearfoot region of the upper.

20 Claims, 17 Drawing Sheets

(56) References Cited

U.S. PATENT DOCUMENTS

| | | | | |
|---|---|---|---|---|
| 8,312,646 | B2 * | 11/2012 | Meschter | A43B 23/0235 36/45 |
| 8,490,299 | B2 * | 7/2013 | Dua | D04B 1/16 36/50.1 |
| 9,078,488 | B1 * | 7/2015 | Meir | D04B 1/22 |
| 9,375,046 | B2 * | 6/2016 | Meir | A43B 23/0205 |
| 9,404,205 | B2 * | 8/2016 | Meir | A43B 1/04 |
| 9,637,847 | B2 * | 5/2017 | Terai | A43B 23/0265 |
| 10,273,604 | B2 * | 4/2019 | Meir | A43B 1/04 |
| 2005/0081402 | A1 * | 4/2005 | Orei | A43B 7/06 36/45 |
| 2008/0006060 | A1 * | 1/2008 | Park | F25B 21/04 66/170 |
| 2008/0041113 | A1 * | 2/2008 | Mori | A41B 11/02 66/54 |
| 2014/0245637 | A1 * | 9/2014 | Fahmi | A43B 23/0235 36/84 |
| 2016/0090670 | A1 * | 3/2016 | Meir | A43B 23/0205 12/142 G |
| 2019/0037968 | A1 | 2/2019 | DeWillie et al. | |
| 2019/0223556 | A1 | 7/2019 | Aceves Tinajero et al. | |

FOREIGN PATENT DOCUMENTS

| | | | | |
|---|---|---|---|---|
| CN | 207002950 | U | 2/2018 | |
| DE | 102015116398 | A1 * | 3/2017 | D04B 1/18 |
| DE | 102016102792 | A1 | 8/2017 | |
| WO | WO 2016/053808 | A1 | 4/2016 | |

* cited by examiner

KNITTED CUSHION REGIONS

RELATED APPLICATIONS

This application claims the benefit of U.S. Provisional Application No. 62/658,232, filed on Apr. 16, 2018, which is incorporated herein by reference.

BACKGROUND

The present disclosure relates generally to knitted components and methods of manufacturing knitted components, for example, knitted components for use in footwear applications.

SUMMARY

In one aspect, the present disclosure provides uppers that may include a knitted component having a first surface and a second surface. The knitted component may have at least one integrally knitted cushion region located on the second surface. The cushion region may include a plurality of non-planar structures that project away from the second surface of the knitted upper by at least 1 mm (for example, 2 mm, 3 mm, 4 mm, 5 mm, 10 mm, 15 mm, or greater depth), and the cushion region may be located in a rearfoot region of the upper. The cushion region may be at least partially located in a calcaneus region, and/or at least partially located in an Achilles region. The cushion region may have a shape with an area of at least 1,000 $mm^2$, for example 1,200 $mm^2$, 1,400 $mm^2$, 1,500 $mm^2$, 2,000 $mm^2$, 5,000 $mm^2$, or greater area. The cushion region may have a geometric shape, such as a rectangle, a square, a trapezoid, a rhombus, an oval, a circle, a conic section (e.g., a hyperbolic shape), and other geometric shapes. Or, the cushion region may have a non-geometric shape. The plurality of non-planar structures may be separated by a plurality of base portions, which may be at least partially formed from one or more elasticated yarns. The plurality of non-planar structures may include one or more tubular knit structures, loft portions, or other non-planar structures. The plurality of non-planar structures may have a number of orientations, for example an orientation that is parallel or perpendicular to a heel centerline of the upper. The plurality of non-planar structures may include at least 5, 10, 15, 20, 25, 30, or a greater number of non-planar structures. The knitted component may be formed by a number of different materials. For example, the knitted component may include a thermoplastic polymer (e.g., a thermoplastic polyurethane) that makes up at least 90%, 93.5%, or greater percentage of the weight of the knitted component. The upper may include a second plurality of knitted elements that project from the first surface.

In another aspect, the present disclosure provides articles of footwear, which may include an upper associated with a sole structure. The upper may form a void, and may include an interior surface facing the void and an opposite-facing exterior surface. The upper may include a cushion region that is integrally knitted with a knitted component of the upper. The cushion region may include a plurality of non-planar structures that project into the void and are configured to contact a wearer's heel. The cushion region may begin at or within 5 mm, 10 mm, 20 mm, 30 mm, 40 mm, 50 mm or greater distance from a bite line where the upper meets the sole structure. The knitted upper may include one or more tension zones that are configured to pull the cushion region against the wearer's heel. In such embodiments, the tension zone may be located adjacent to a collar region of the upper, for example in a sub-ankle region of the upper.

Other systems, methods, features and advantages of the present disclosure will be, or will become, apparent to one with skill in the art upon examination of the following figures and detailed description. It is intended that all such additional systems, methods, features and advantages be within the scope of the present disclosure, and be encompassed by the following claims.

BRIEF DESCRIPTION OF THE DRAWINGS

The present disclosure can be better understood with reference to the following drawings and description. The components in the figures are not necessarily to scale, emphasis instead being placed upon illustrating the principles of the present disclosure. Moreover, in the figures, like referenced numerals designate corresponding parts throughout the different views.

The drawings described herein are for illustration purposes only and are not intended to limit the scope of the present disclosure in any way.

DETAILED DESCRIPTION OF THE PREFERRED EMBODIMENTS

Figure 1A:
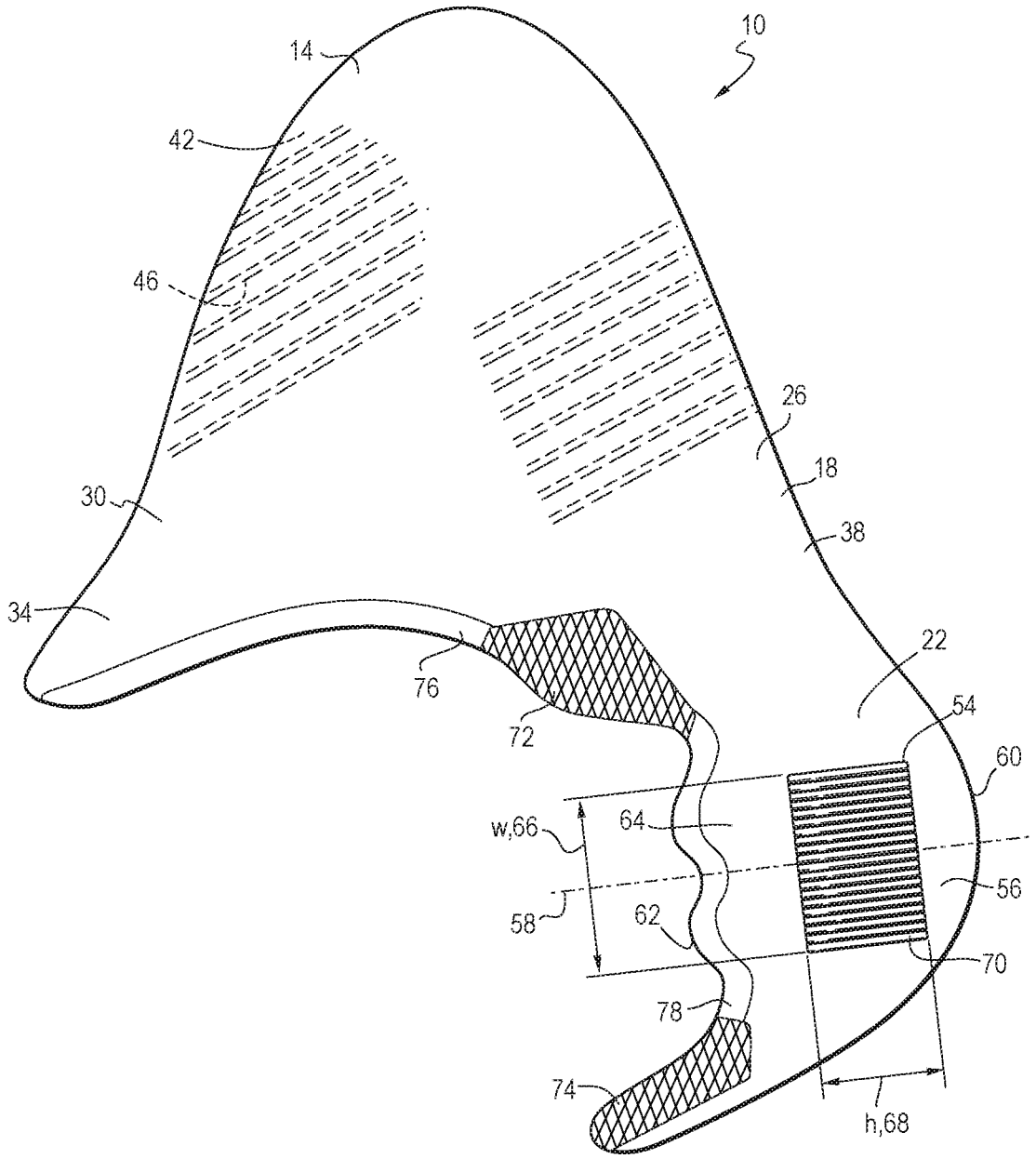
FIG. 1A shows an upper for an article of footwear according to one aspect.
Figure 3:
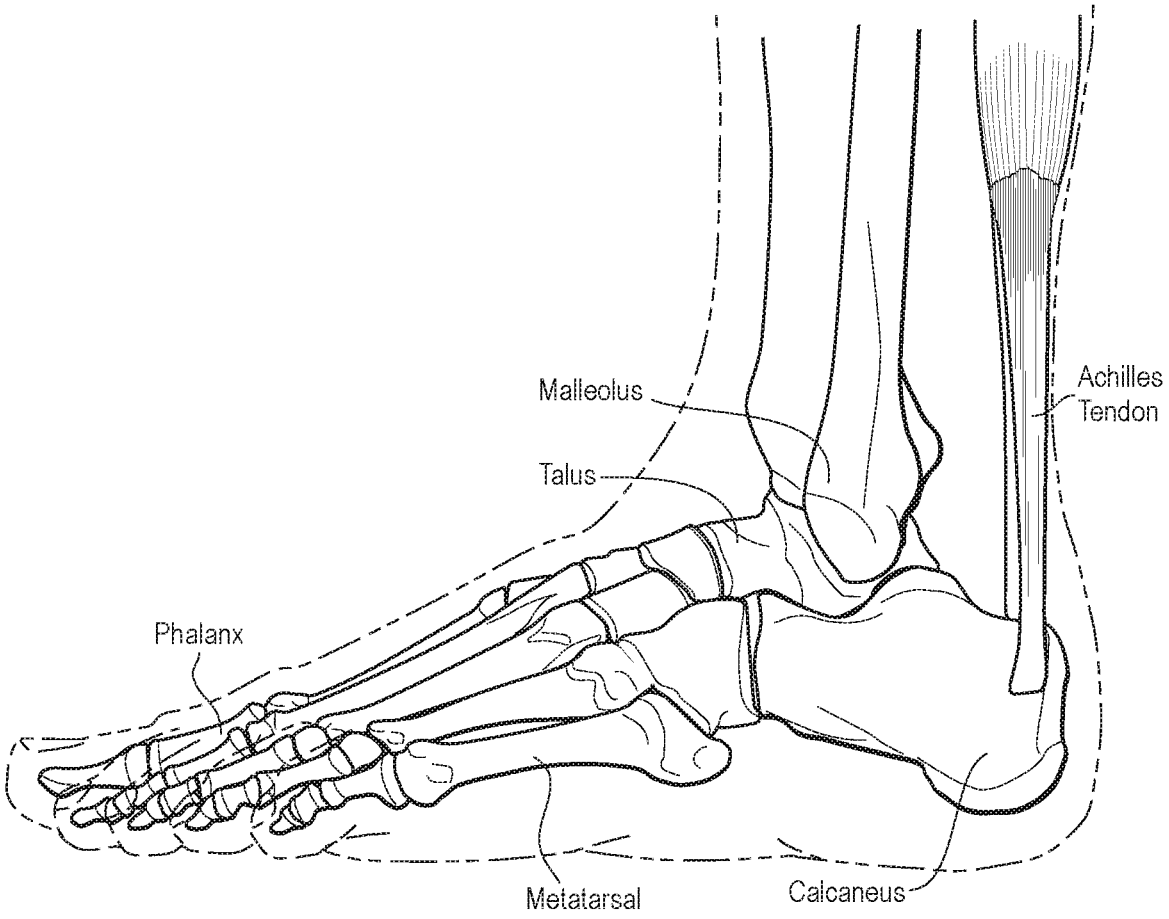
FIG. 3 shows a schematic of the anatomy of a human foot.

FIG. 1A illustrates an upper 10 for an article of footwear. When incorporated into an article of footwear, the upper 10 may generally provide a comfortable and secure covering for wearer's foot. The upper 10 may be divided into a forefoot region 14, a midfoot region 18, and a rearfoot region 22. Referring to FIG. 1A in conjunction with FIG. 3, when the upper 10 is incorporated into an article of footwear, the forefoot region 14 generally includes portions that correspond with the toes and the joints connecting the metatarsals with the phalanges. The midfoot region 18 generally includes portions of the upper 10 that correspond with an arch area of the foot. The rearfoot region 22 includes portions of the upper 10 that correspond with rear portions of the foot, including areas that cover the calcaneus bone (which forms a portion of a wearer's heel). Additionally, the rearfoot region 22 may cover some or all of the wearer's malleoli and talus (which form a portion of the ankle), and may extend forward of those areas. The upper 10 also includes a lateral side 26 and a medial side 30, which extend through each of forefoot region 14, midfoot region 18, and rearfoot region 22. More particularly, the lateral side 26 corresponds with an outside area of the foot (i.e., the surface that faces away from the other foot), and the medial side 30 corresponds with an inside area of the foot (i.e., the surface that faces toward the other foot). The forefoot region 14, midfoot region 18, and rearfoot region 22 and lateral side 26 and medial side 30 are not intended to demarcate precise areas of the upper 10. Rather, they are intended to represent general areas of the upper 10 to aid in the following discussion.

Referring still to FIG. 1A, at least a portion of upper 10, and potentially substantially the entirety of upper 10, may be formed of a knitted component 34. The knitted component 34 may be formed as an integral one-piece element during a knitting process, such as a weft knitting process (e.g., with a flat knitting machine with one, two, or more needle beds, or with a circular knitting machine), a warp knitting process, or any other suitable knitting process. That is, the knitting process on the knitting machine may substantially form the knit structure of the knitted component 34 without the need for significant post-knitting processes or steps. Alternatively, two or more portions of the knitted component 34 may be formed separately as two or more distinct knitted components (each of which being integrally knit), and may be joined following the knitting process. The knitted component 34 may include an interior surface 38 that may eventually face an interior void or face a wearer's foot when the knitted component is incorporated into an article of footwear. The knitted component 34 may also include an exterior surface 42 that may face away from the void of an article of footwear. In some embodiments, e.g., embodiments with separable layers, the knitted component 34 may include one or more internal surfaces.

Generally, forming an upper at least partially with a knitted component may provide advantageous characteristics including, but not limited to, a particular degree of stretch (for example, as expressed in terms of Young's modulus), breathability, bendability, strength, moisture absorption, weight, abrasion resistance, and/or a combination thereof. These characteristics may be accomplished by selecting a particular single layer or multi-layer knit structure (e.g., a ribbed knit structure, an interlock structure, a single jersey knit structure, a double jersey knit structure, additional knit structures, or any combination thereof), by varying the size and tension of the knit structure, by using one or more yarns formed of a particular material (e.g., a polyester material, a relatively inelastic material, or a relatively elastic material such as elastane), by selecting yarns of a particular size (e.g., denier), and/or a combination thereof. A knitted component may also provide desirable aesthetic characteristics by incorporating yarns having different colors, textures or other visual properties arranged in a particular pattern. The yarns themselves and/or the knit structure(s) formed by one or more of the yarns of the knitted component may be varied at different locations such that the knitted component has two or more portions with different properties (e.g., a portion forming the throat area of the upper may be relatively elastic while another portion may be relatively inelastic). In some embodiments, a knitted component may incorporate one or more materials with properties that change in response to a stimulus (e.g., temperature, moisture, electrical current, magnetic field, or light). For example, a knitted component may include yarns formed of at least one thermoplastic polymer material or material composition (e.g., at least one polyurethane, polyamide, polyolefin, and/or nylon) that transitions from a solid state to a softened or liquid state when subjected to certain temperatures at or above its melting point and then transitions back to the solid state when cooled. For example, at least a portion of a knitted component may include a first thermoplastic polymer. Or, at least half of the knitted component may include the first thermoplastic polymer. Or, a majority of the knitted component or substantially all of the knitted component may include the first thermoplastic polymer. As one non-limiting example, a knitted component may include a higher percentage by weight (mass) of a resin that makes up a first thermoplastic polymer type. As such, at least 90% (e.g., 93.5%, 95%, etc.) of the weight (mass) of the knitted component is the resin that makes up the first thermoplastic polymer. It will be appreciated that the first thermoplastic polymer may be present in higher or lower amounts (%) as necessary or desired.

As shown in FIG. 1A, the knitted component 34 may be knitted in a two-dimensional configuration (e.g., through a flat knitting process), which may be subsequently formed into the shape of a wearer's foot through post-knitting methods, e.g., lasting. In other embodiments, the knitted component may be knitted in a three-dimensional configuration by which the knitting process (e.g., a flat or a circular knitting process) knits the upper substantially into the shape of a wearer's foot. Such a three dimensionally-knitted component may include an opening for receiving a wearer's foot within an overfoot portion. The overfoot portion may be joined with an underfoot portion as a result of the knitting process, e.g., around a perimeter of the underfoot portion. Such a three dimensionally-knitted component may resemble a bootie or a sock following the knitting process. However, it shall be understood that the shapes of the knitted components shown in the figures are merely exemplary, as other knitted components embodying the constructions disclosed herein may be knitted in different configurations. For example, a knitted component may be knitted substantially in a two-dimensional U-shape, a C-shape, another one-piece shape with one or more edges in different locations, or a multi-piece configuration. Accordingly, as used herein, the term "knitted component" is not intended to limit said knitted component to a particular shape, manufacturing process, or particular edge configuration.

Figure 1B:
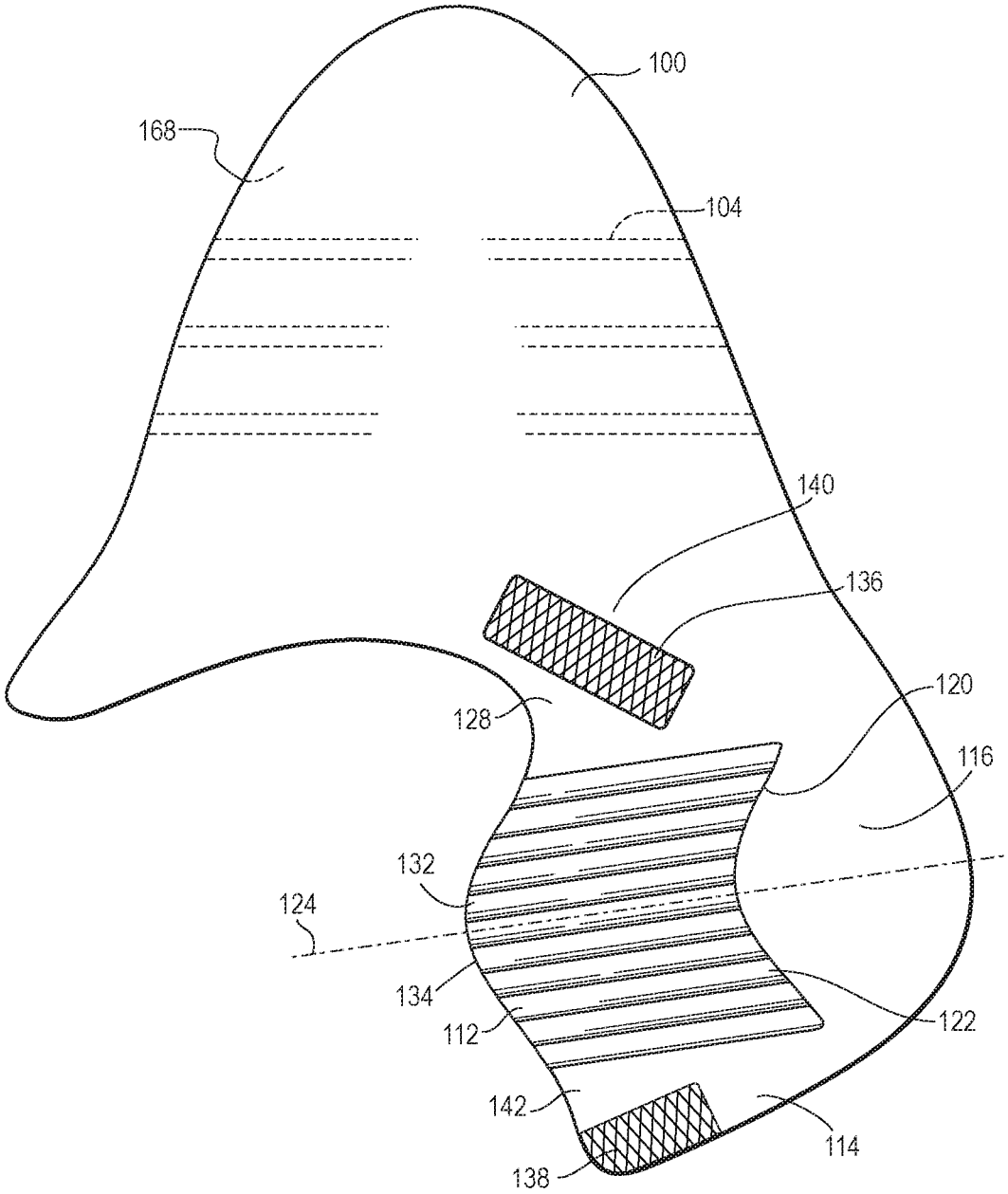
FIG. 1B shows an upper for an article of footwear according to another aspect.
Figure 1C:
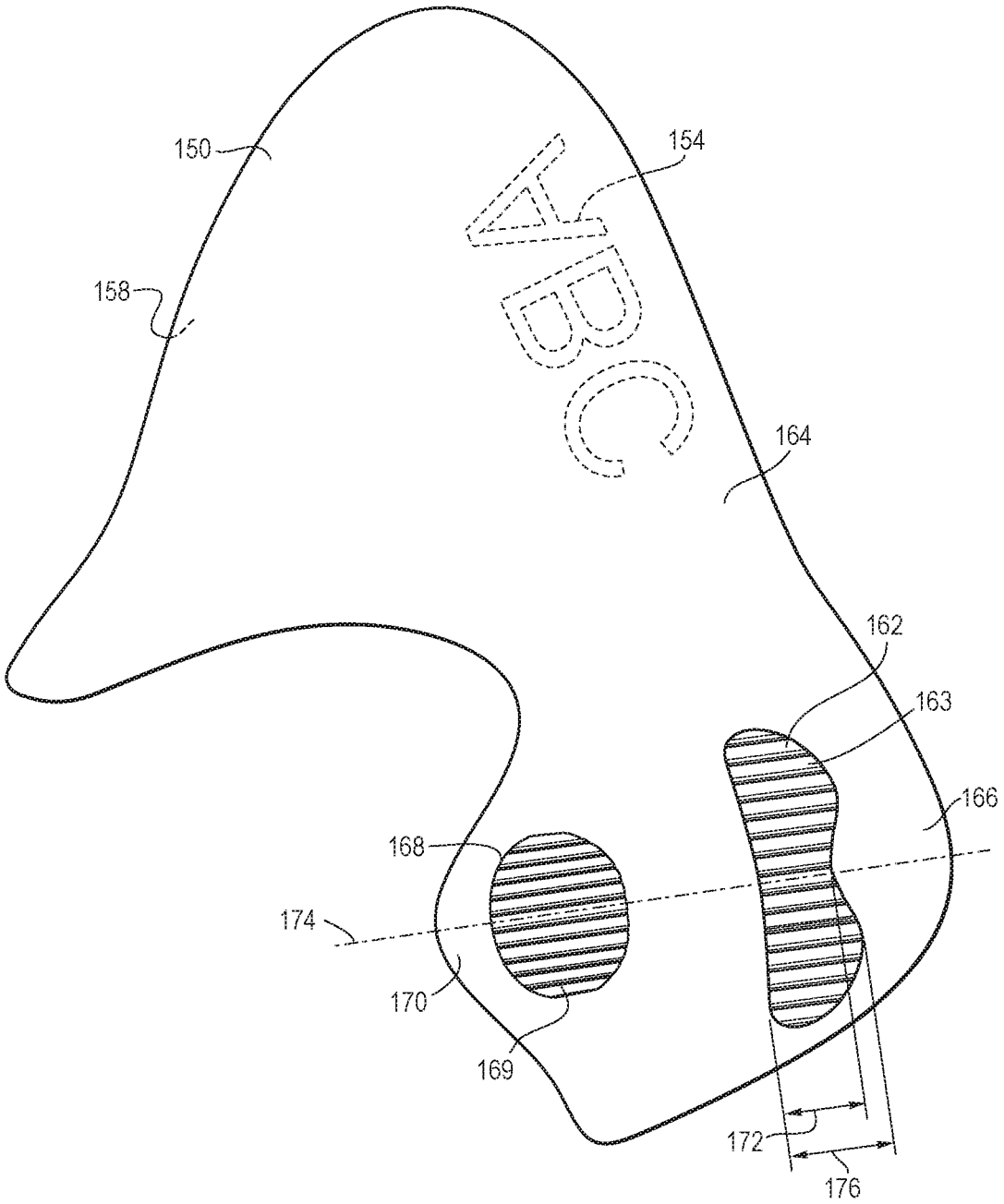
FIG. 1C shows an upper for an article of footwear according to another aspect.
Figure 1D:
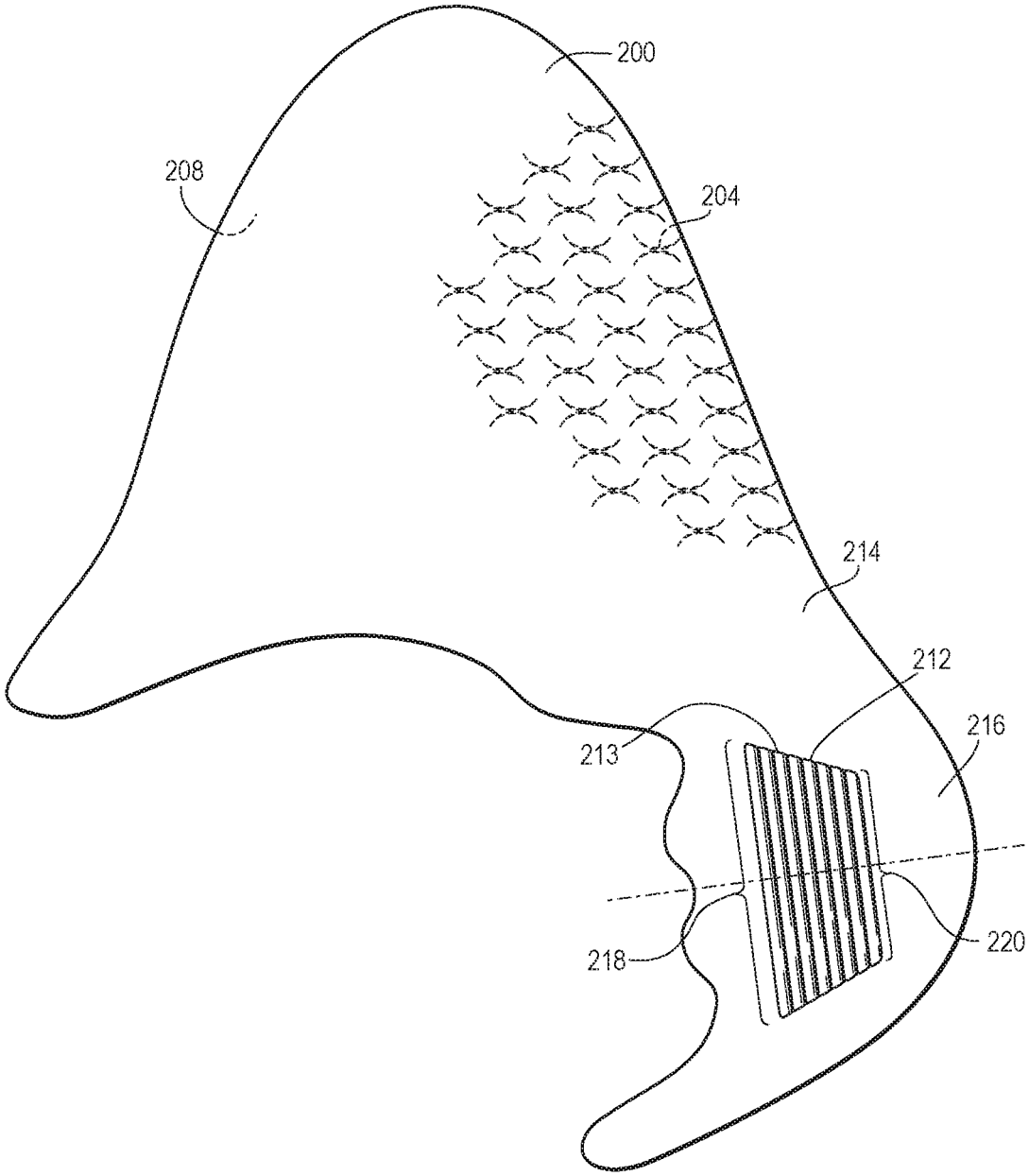
FIG. 1D shows an upper for an article of footwear according to another aspect.
Figure 1E:
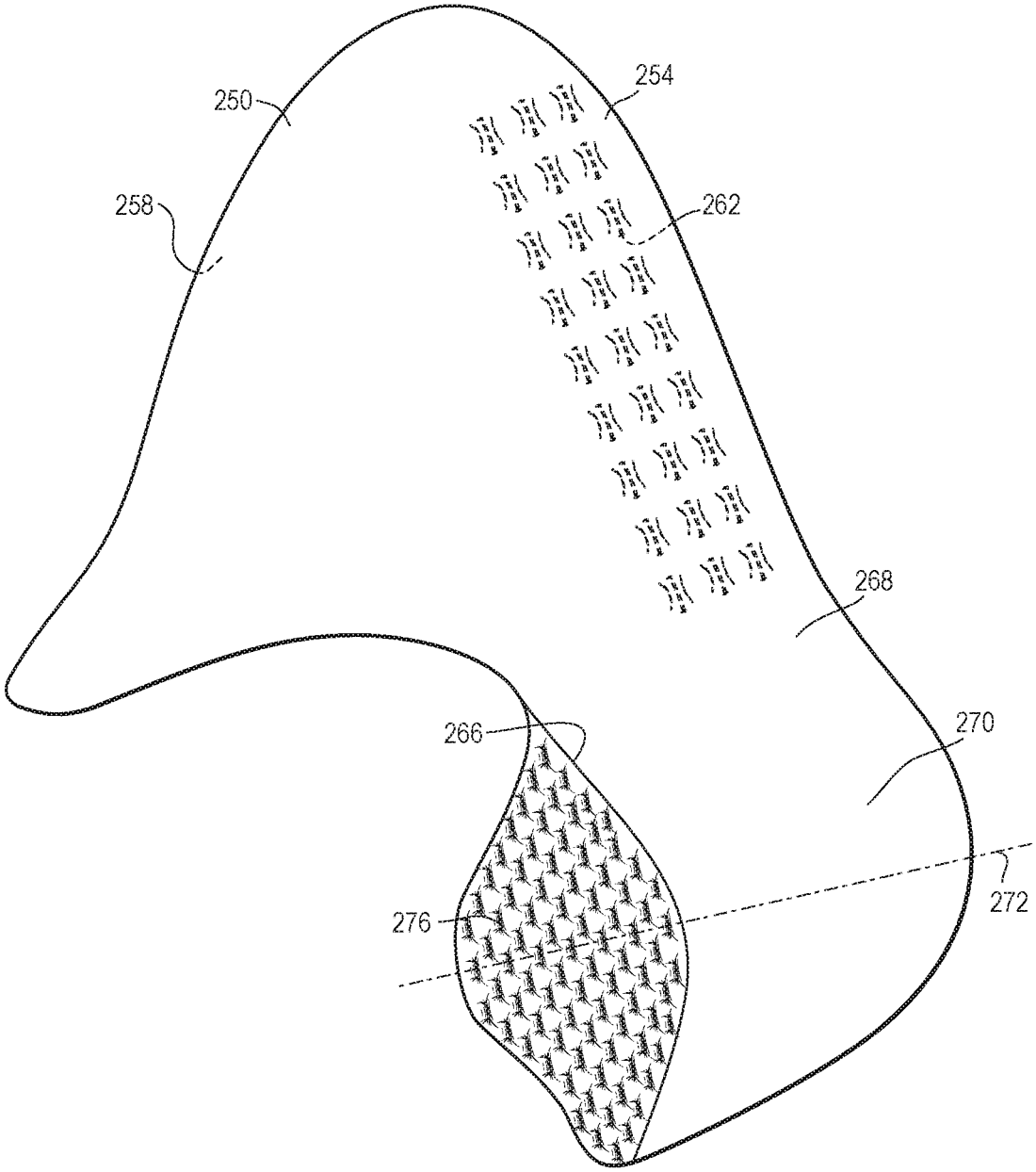
FIG. 1E shows an upper for an article of footwear according to another aspect.

In any embodiment discussed herein, a knitted component may include any number of integrally knitted features on an exterior surface. For example, the knitted component 34 of FIG. 1A includes non-planar structures 46 that are integrally knitted with the knitted component 34 and extend away from the exterior surface 42, e.g., to enhance durability and/or to provide an appealing aesthetic. Such non-planar structures 46 may together resemble a separate component (e.g., a cage) that surrounds the upper 34, although the non-planar structures 46 may be integrally knitted with the upper 34 and may form part of the exterior surface 42. Additionally or alternatively and as shown in FIG. 1B, a knitted component 100 may include one or more channels 104 comprising two textile layers that are freely-separable in certain locations, wherein the channels 104 may extend away from an exterior surface 108, such as to provide channels for laces or other materials. Additionally or alternatively and as shown in FIG. 1C, a knitted component 150 may include knitted indicia 154 on an exterior surface 158. Additionally or alternatively and as shown in FIG. 1D, a knitted component 200 may include one or more pillow-like, cloud-like, or quilt-like loft portions 204 on an exterior surface 208 that provide cushioning and appealing aesthetic, such as those as described in U.S. Provisional Patent Application No. 62/574,989, the entirety of which is expressly incorporated by reference into this application. Additionally or alternatively and as shown in FIG. 1E, a knitted component 250 may include one or more knitted recesses 254 in an exterior surface 258, at least one of which recesses 254 may or may not reveal one or more floating yarns 262, such as those as described in U.S. patent application Ser. No. 15/875,821, the entirety of which is expressly incorporated by reference into this application. Additionally or alternatively, a knitted component may include one or more knitted structures as described in U.S. Provisional Patent Application No. 62/541,500, the entirety of which is expressly incorporated by reference. The foregoing integrally knitted features are merely exemplary and intended to show a subset of the numerous potential knitted features that may be found on an exterior surface of the knitted components described herein.

Figure 2A:
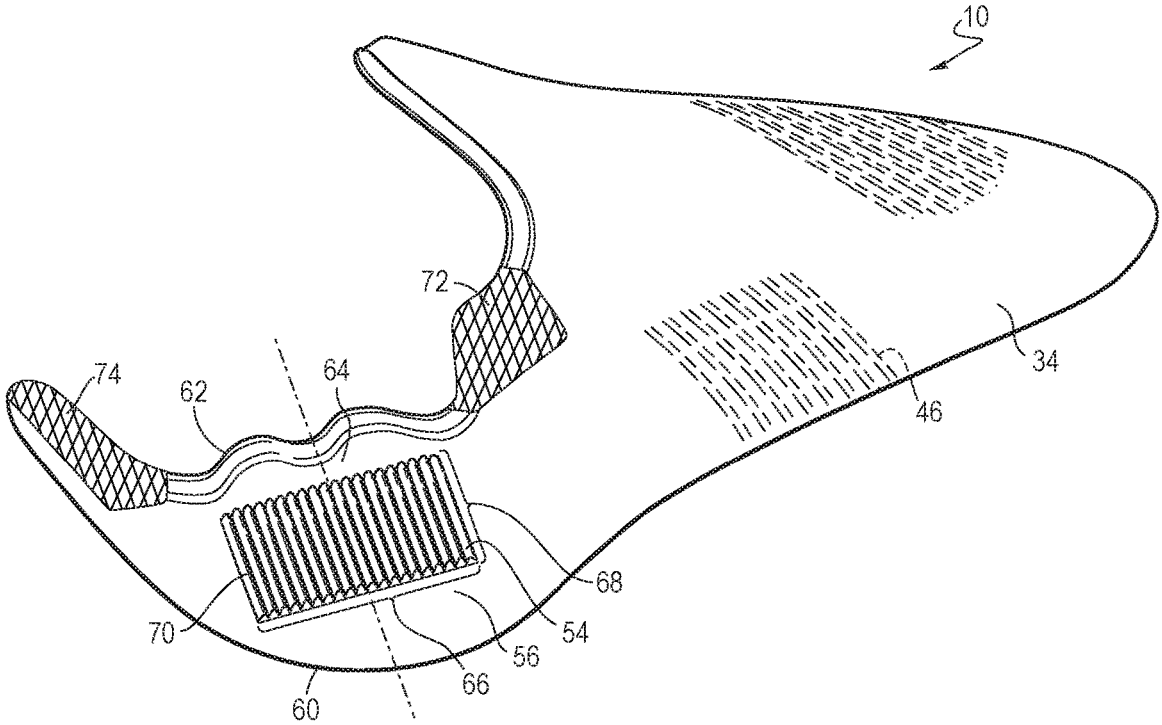
FIG. 2A shows a perspective view of the upper of FIG. 1A.

Referring to FIGS. 1A and 2A, the rearfoot region 22 of the upper 10 may include one or more cushion regions 54 that are integrally knitted with the knitted component 34 and project away from the interior surface 38 (i.e., the surface that may eventually face a wearer's foot and/or the interior of an article of footwear). Generally, the structure, shape, dimensions, and other properties of the cushion region(s) may vary between embodiments; however, the cushion region(s) are generally integrally knitted with the knitted component (i.e., substantially formed from the same knitting process that forms the knitted components, without significant post processing steps), project away from the interior surface of the knitted component, and are configured to provide cushioning and support to the rear portion of a wearer's foot, for example the heel (including the calcaneus bone) and/or the Achilles tendon (see FIG. 3). Although the cushion regions disclosed herein may vary in terms of area, each cushion region may generally have an area of at least approximately 1,000 $mm^2$; in some embodiments, each cushion region may have an area of at least 1,200 $mm^2$, 1,400 $mm^2$, 1,500 $mm^2$, 2,000 $mm^2$, 5,000 $mm^2$, or greater area. It is expressly contemplated in this application that a knitted component may have a single cushion region or a plurality of cushion regions. Although the following disclosure generally discusses cushion regions in singular form, it shall be appreciated that this does not in any way limit the number of cushion regions that may be integrally knitted with a knitted component.

In conventional footwear construction, the interior surface of the upper (and any knitted component that forms part of the upper) is relatively smooth and free of elements that might project away from an interior surface and toward a wearer's foot, out of concern for maximizing comfort. In contrast to this traditional construction, the cushion regions described herein project away from the interior surface of the knitted component, but due to their knitted construction, shape, size, location, and materials, will not cause the wearer discomfort, but will instead advantageously cushion the wearer's foot when the knitted component is incorporated into an article of footwear. By projecting away from an interior surface of the knitted component in a location that corresponds with a rear portion of a wearer's foot, the cushion region may advantageously prevent the wearer's foot from slipping upwards and outwards from the article of footwear. Additionally, in some embodiments, the cushion region may obviate the need for traditional heel counters and other components when the knitted component is incorporated into an article of footwear, thereby reducing weight and cost. Still further, in some embodiments, the cushion region may be formed from one or more materials that are similar or identical to other materials utilized in the knitted component, thereby improving recyclability of the knitted component.

Referring again to FIGS. 1A, 2A, and 3, in some embodiments the cushion region 54 may be at least partially located in a calcaneus region 56 of the knitted component 34, i.e., a location that may eventually correspond with at least a portion of a wearer's calcaneus bone when the knitted component 34 is incorporated into an article of footwear. This application contemplates that the calcaneus region 56 of the knitted component 34 may eventually correspond with any aspect of the wearer's calcaneus bone, for example an upper portion, a lower portion, a rear portion, a medial portion, and a lateral portion of the calcaneus bone. Generally, when an upper is incorporated into an article of footwear, the calcaneus region may begin approximately at a bite line where the upper meets a sole structure, and may end approximately 25 mm-50 mm above the bite line. Similarly, the calcaneus region may begin approximately 25 mm-50 mm above a lower edge or outer edge of a knitted component, and may end approximately 50 mm-100 mm above the lower or outer edge. The calcaneus region 56 may coincide with a heel centerline 58 of the knitted component 34, although its precise boundaries may not be apparent in the knitted component 34 itself. The calcaneus region 56 may extend in a medial and a lateral direction away from the heel centerline 58 by up to approximately 30 mm, 40 mm, 50 mm or more. In another dimension, the calcaneus region 56 may extend toward and/or to an outer edge 60 and/or a collar edge 62 of the knitted component.

Figure 2B:
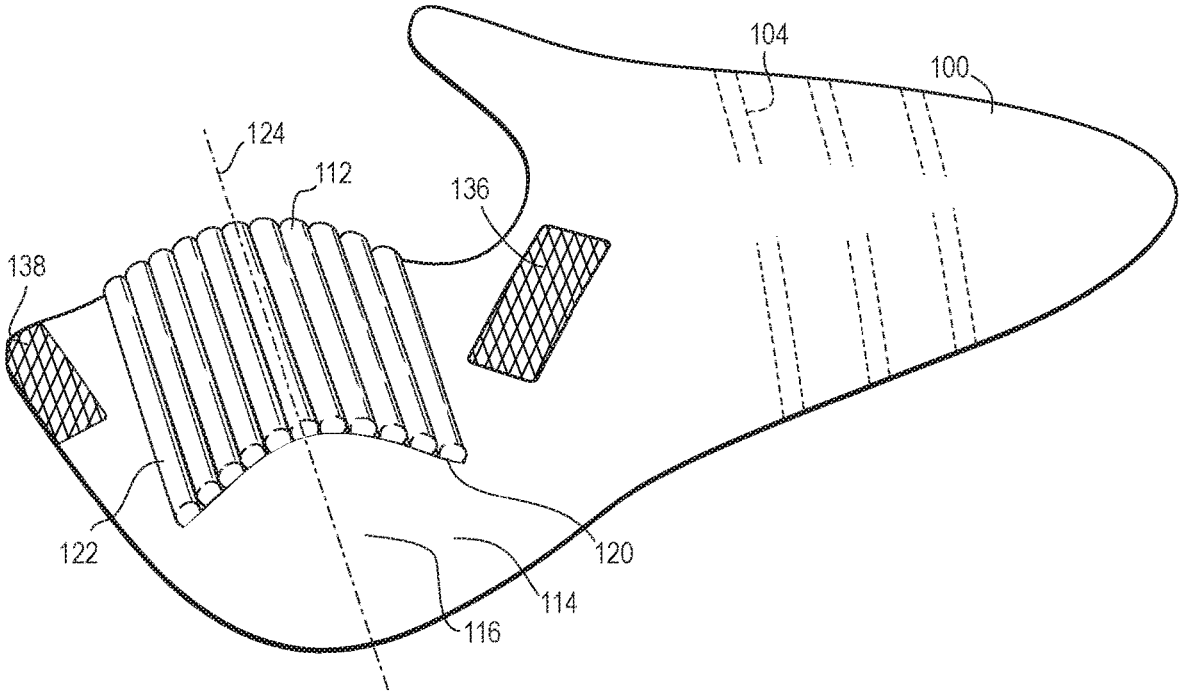
FIG. 2B shows a perspective view of the upper of FIG. 1B.
Figure 2C:
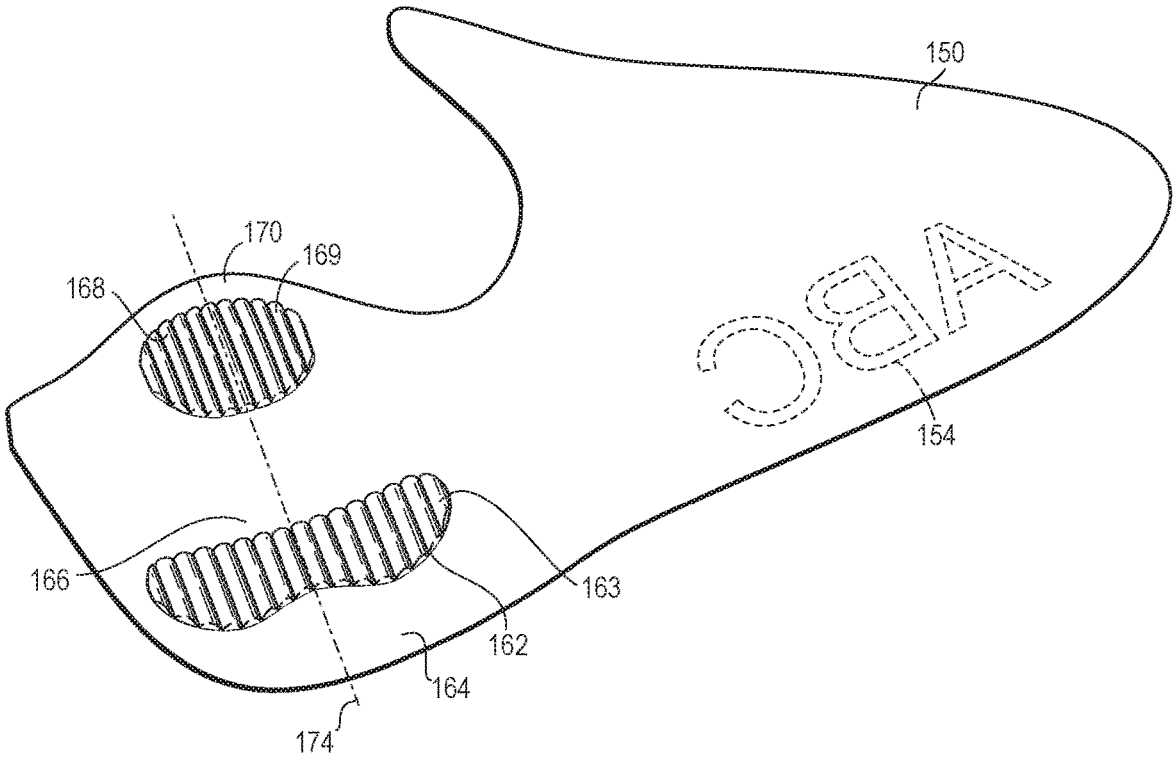
FIG. 2C shows a perspective view of the upper of FIG. 1C.

In various embodiments, the cushion region may cover none of the calcaneus region, part of the calcaneus region, or substantially all of the calcaneus region. In this application, the cushion region may cover "substantially all" the calcaneus region if it covers an area of at least approximately 400 $mm^2$ that is positioned within approximately 20 mm of either side of the heel centerline. For example, in FIGS. 1A and 2A, the knitted cushion region 54 covers substantially all of the calcaneus region 56 by extending approximately 30 mm-45 mm from either side of the heel centerline 58 and extending approximately 20 mm-40 mm in a direction parallel to the heel centerline 58. In other, similar embodiments, the horizontal and vertical dimensions may each vary from approximately 20 mm to approximately 100 mm or greater. In the alternative embodiment of FIGS. 1B and 2B, a cushion region 112 on an interior surface 114 covers a portion of a calcaneus region 116 because the curved edge 120 covers only an upper portion of the calcaneus region 116, although the cushion region 112 extends in the medial and lateral directions by approximately 20-30 mm on either side of a heel centerline 124. In the alternative embodiment of FIGS. 1C and 2C, a first cushion region 162 on an interior surface 164 covers a portion of a calcaneus region 166. In the alternative embodiment of FIGS. 1D and 2D, a trapezoidal cushion region 212 on an interior surface 214 substantially covers a calcaneus region 216. In the alternative embodiment of FIGS. 1E and 2E, a cushion region 266 on an interior surface 268 does not cover any part of a calcaneus region 270.

Additionally or alternatively, the cushion region(s) in some embodiments may be at least partially located in an Achilles region of the knitted component, i.e., a location that may eventually correspond with at least a portion of a wearer's Achilles tendon when the knitted component is incorporated into an article of footwear. This may provide additional cushion and protection for the wearer's Achilles tendon. Referring to FIG. 1A, an Achilles region 64 of the knitted component 34 may be located along the heel centerline 58 and closer to the collar edge 62 than the calcaneus region 56. Not all knitted components may have an Achilles region. In those that do, the degree to which the cushion region may be located in the Achilles region, if at all, may vary between embodiments. For example, in the embodiment of FIGS. 1B and 2B, the knitted component 100 includes a high collar region 128 that covers an Achilles region 132. In this embodiment, the cushion region 112 extends along the interior surface 114 from the calcaneus region 116 to a collar edge 134, thereby occupying at least a portion of the Achilles region 132. In other embodiments, such as in FIGS. 1C and 2C, a second cushion region 168 may extend only partially into an Achilles region 170, while the cushion region 162 covers at least part of the calcaneus region 166. In still other embodiments, such as in FIGS. 1E and 2E, the cushion region 266 may extend away from a heel centerline 272 in an Achilles region 274 along a lateral and/or medial side of a interior surface of a knitted component, for example to provide increased Achilles support.

As noted above, the size and shape of the cushion region may vary between embodiments. The shape that circumscribes the cushion region may have a geometric or non-geometric shape, and may be symmetrical or asymmetrical. Exemplary geometric shapes include rectangles, squares, trapezoids, rhombuses, ovals, circles, conic sections (e.g., hyperbolic shapes), and other geometric shapes. Non-geometric shapes may include organic shapes such as kidney shapes and other contoured shapes, such as those that may correspond with the anatomy of a wearer's foot. The area of the two-dimensional shape that circumscribes the cushion region may vary between embodiments, for example from approximately 400 $mm^2$ to approximately 5,000 $mm^2$ or greater. By comparison, the cushion region may have a surface area that exceeds the area of the two-dimensional shape that circumscribes the cushion region due to the presence of non-planar structures, discussed below. For example, the cushion region 54 of FIGS. 1A and 2A has a rectangular shape with a width, w, 66 of approximately 60 mm-90 mm and a vertical height, h, 68 in a direction parallel to the heel centerline 58 of approximately 20 mm-40 mm. In similar embodiments, the horizontal and vertical dimensions may each vary from approximately 20 mm to approximately 100 mm or greater. In the alternative embodiment of FIGS. 1B and 2B, the cushion region 112 has a non-geometric shape that extends from an upper portion of the calcaneus region 116 into the Achilles region 132, extending to the collar edge 134. The cushion region 112 also extends in the medial and lateral directions by approximately 20 mm-30 mm on either side of the heel centerline 124. In the alternative embodiment of FIGS. 1C and 2C, the first cushion region 162 has an organic non-geometric shape with a first height, $h_1$, 172 along a heel centerline 174. The height of the first cushion region 162 increases to a second height, $h_2$, 176 at other locations that are spaced away from the heel centerline 174, e.g., to better conform to the shape of a wearer's foot. In the alternative embodiment of FIGS. 1D and 2D, the cushion region 212 has a trapezoidal shape with a wider first width, $w_1$, 218 and a narrower second width, $w_2$, 220. The foregoing shapes and dimensions are merely exemplary and not intended to limit the number of potential shapes and dimensions that the cushion region may reflect, but rather to exhibit the breadth of potential shapes, dimensions, and locations of the cushion region(s).

Figure 2D:
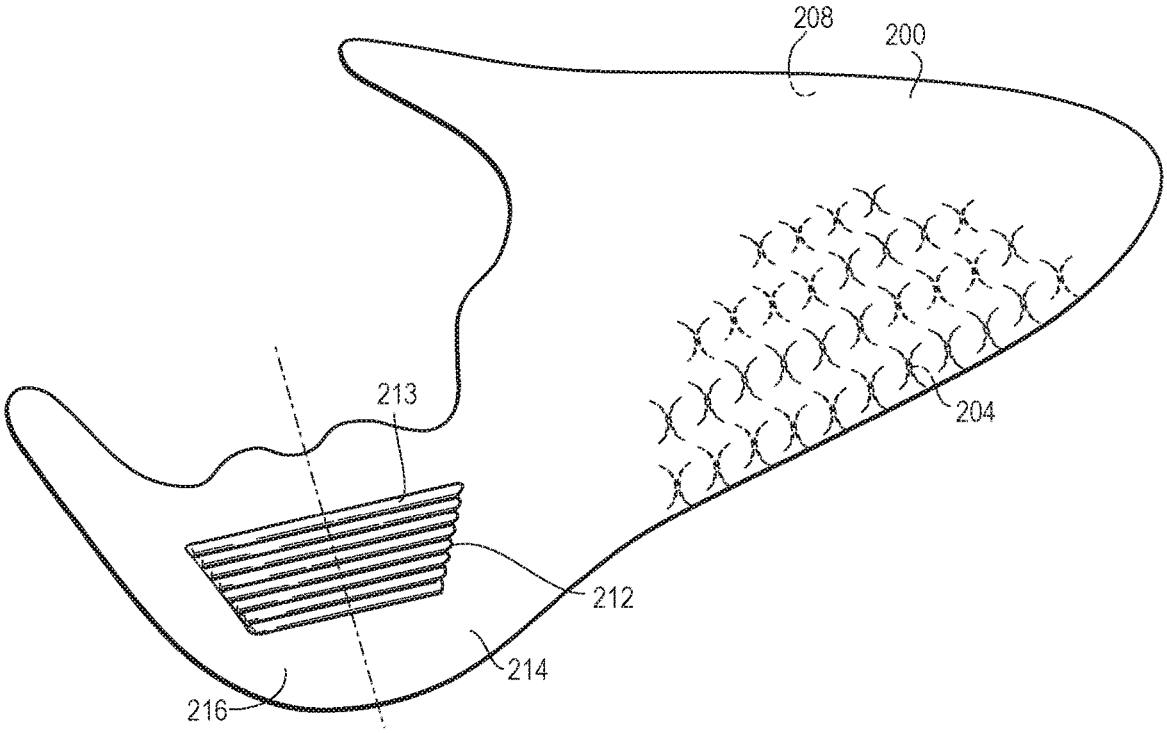
FIG. 2D shows a perspective view of the upper of FIG. 1D.
Figure 2E:
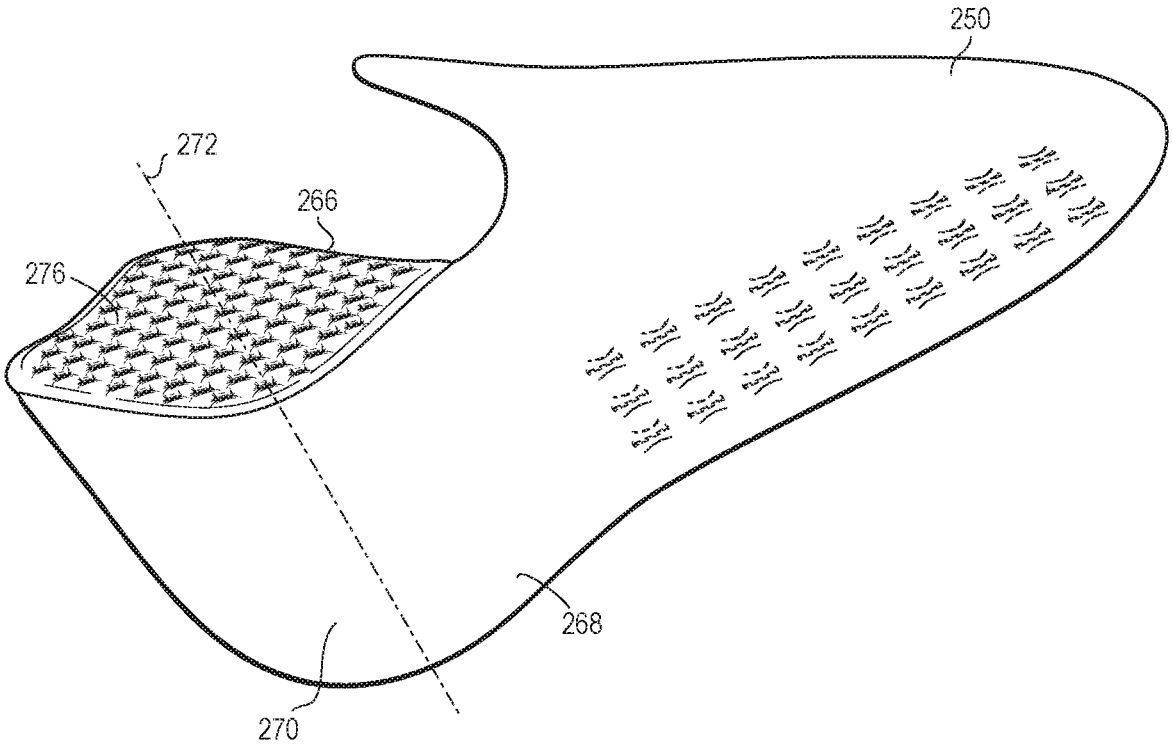
FIG. 2E shows a perspective view of the upper of FIG. 1E.
Figure 4A:
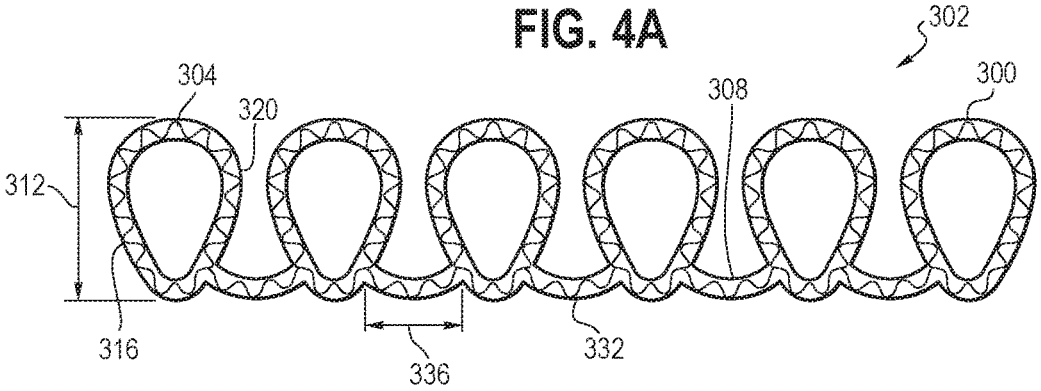
FIG. 4A shows a section view of a knitted component according to one aspect.
Figure 4B:
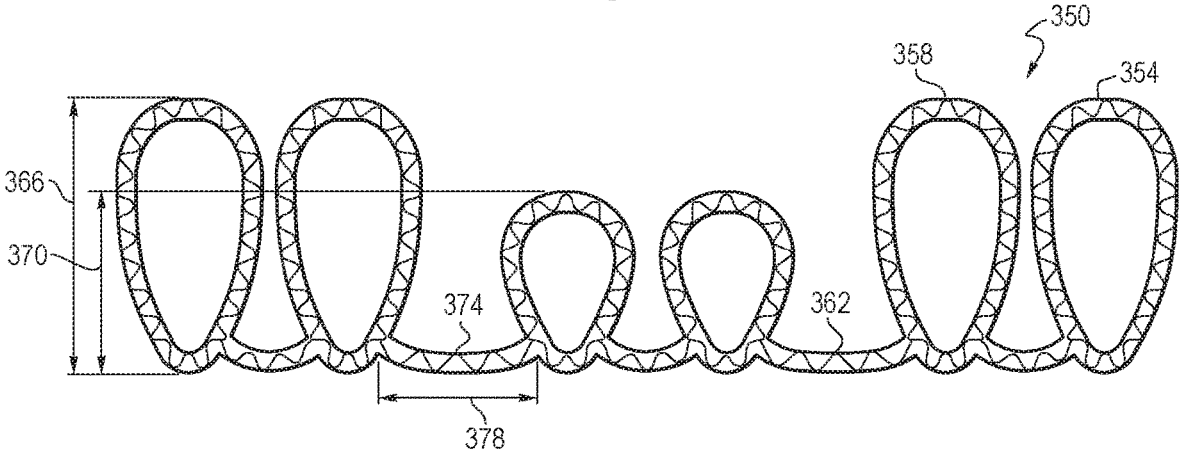
FIG. 4B shows a section view of a knitted component according to another aspect.

In any embodiment, the cushion region may include one or more non-planar structures that enhance cushioning and provide volume to the cushion region by extending away from the interior surface of the knitted component. For example, the cushion region 54 of FIGS. 1A and 2A includes approximately twenty non-planar structures 70, although other embodiments may include a greater or fewer number of non-planar structures, e.g., two, four, five, ten, twenty-five, thirty, or more non-planar structures. In the alternative embodiment of FIGS. 1B and 2B, the cushion region 112 includes a plurality of non-planar structures 122 that each have a different height. In the alternative embodiment of FIGS. 1C and 2C, the first and second cushion regions 162, 168 each include a plurality of non-planar structures 163, 169, respectively. In the embodiment of FIGS. 1D and 2D, the cushion region 212 includes a plurality of horizontal non-planar structures 213. In the embodiment of FIGS. 1E and 2E, the cushion region 266 includes a plurality of non-planar structures 276 formed as loft portions. Referring to the section view of FIG. 4A, a knitted component 300 includes an integrally knitted cushion region 302, which has a plurality of non-planar structures 304 that project away from a surface 308. Each non-planar structure 304 may extend away from the surface 308 by a depth, d, 312 which may be at least approximately 1 mm, for example 2 mm, 3 mm, 4 mm, 5 mm, 10 mm, 15 mm, or greater depth. When the knitted component 300 is incorporated into an article of footwear, the non-planar structures 304 extend into the void formed by the knitted component 304, i.e., toward a wearer's foot. In the embodiment of FIG. 4A, each non-planar structure 304 extends away from the surface 308 by the same depth, d, 312. However, as shown in the alternative section view of FIG. 4B, a knitted component 350 may include a cushion region 354 with non-planar structures 358 that extend away from a surface 362 by different distances $d_1$ (366) and $d_2$ (370), for example to form a more ergonomic contour.

Referring again to FIG. 4A, the non-planar structures may be spaced apart by base portions 332, which may be formed of similar or dissimilar materials as the non-planar structures 304. In such embodiments, each base portion 332 has a width, $w_1$, 336 that affects the spacing between the non-planar structures 304. In some embodiments, each base portion may have a very small width, e.g., 1-2 mm, which may correspond with a single course of yarn or a small number of courses. In such embodiments, the non-planar structures may be so closely spaced so that adjacent non-planar structures nearly touch each other or actually touch each other. In other embodiments, such as shown in the section view of FIG. 4B and also potentially in embodiments where the non-planar structures have an orientation that is not parallel with the heel centerline, a base portion 374 may have a greater width, $w_2$, 378 so that the non-planar structures are spaced apart by a greater distance. In all embodiments, the cushion region may include base portions having one or more widths.

Generally suitable non-planar structures may include solid rib structures, tubular rib structures, and loft portions. Rib structures may be linear or non-linear. Referring again to FIG. 4A, generally, the non-planar structures 304 may be a tubular rib structure, which may be an area of a knitted component constructed with two or more integrally knit and overlapping knitted portions 316, 320 that form a tube or tunnel. Although the sides or edges of the knitted portions 316, 320 may be secured to the other layer, a central area is generally unsecured to form the hollow tube or tunnel. One exemplary type of tubular rib structure is an ottoman structure. For example, the cushion region 54 of the knitted component 34 of FIG. 1A includes a plurality of elongate, tubular, non-planar structures 70 that extend away from the interior surface 38. Hollow rib structures may generally offer improved cushioning over solid rib structures because each hollow tubular rib structure may compress in response to a force, e.g., the force of a wearer's heel. In some cases, tubular rib structures may include one or more additional components that are disposed within the tube, for example to increase cushioning or loft, such as one or more yarns or strands.

Figure 4C:
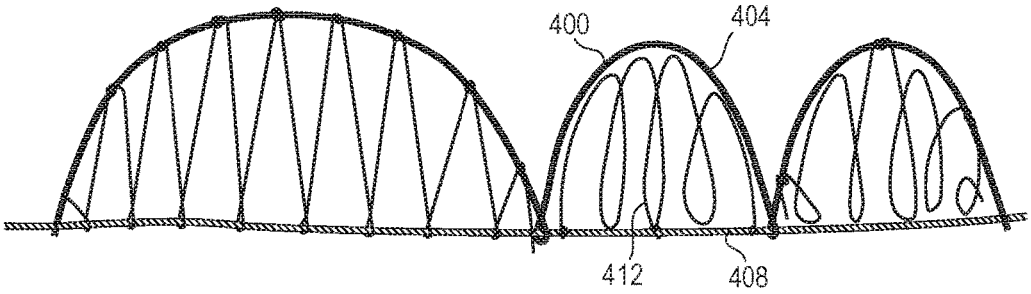
FIG. 4C shows a section view of a knitted component according to another aspect.

In other embodiments, a cushion region may include other suitable non-planar structures as described in U.S. Provisional Patent Application No. 62/574,989, the entirety of which is expressly incorporated by reference into this application. Such non-planar structures may include one or more integrally knitted cloud-like, quilt-like, or pillow-like loft portions formed by knitting voids between freely separable knit layers, and also by knitting a material (e.g., a monofilament strand) into the voids in order to impart cushioning or loft to the knitted structure. Such an alternative non-planar structure is shown in the embodiment of FIGS. 1E and 2E, wherein the cushion region 266 includes a plurality of non-planar structures 276 that are loft portions. Referring to the section view of FIG. 4C, a loft portion 400 may include a portion of a first knit layer 404 that extends away from an underlying portion of a second knit layer 408, and a material 412 that is knitted in between the first and second layers 404, 408. Generally, within each loft portion, the first layer may extend away from the second layer by a distance of about 1-2 mm, about 2-3 mm, about 3-4 mm, about 4-5 mm, or a greater distance. In other words, the cushion region may project away from an interior surface of the knitted component by 2-3 mm, about 3-4 mm, about 4-5 mm, or a greater distance. Such loft portions may have an approximately geometric shape such as a circle, a triangle, a square, a rectangle, a rhombus, a pentagon, a hexagon, a curve (e.g., a sinusoid or other curve), etc. In still other embodiments, a cushion region may include one or more pods as described in U.S. Provisional Patent Application No. 62/541,500, the entirety of which is expressly incorporated by reference.

Generally, the non-planar structures may be knitted in an array, a pattern, a mosaic, a lattice, or other arrangement to enhance cushion, to improve the interface between the upper and a wearer's heel region, for improved aesthetics, or for other advantage. For example, the plurality of tubular non-planar structures 70 of FIGS. 1A and 2A are knitted in a closely-spaced parallel array, with each tubular non-planar structure 70 being oriented parallel to the heel centerline 58 of the knitted component (a "vertical" orientation). The vertical orientation of the tubular non-planar structures 70 of FIG. 1A may correspond with a course-wise direction of the knitted component 34, but may alternatively correspond with a wale-wise direction in other embodiments. The vertical orientation of the tubular non-planar structures 70 of FIG. 1A also corresponds with the orientation of a wearer's Achilles tendon, which may advantageously enable each tubular non-planar structure 70 to conform independently to a wearer's heel and/or Achilles tendon. However, in other embodiments, the non-planar structures may have one or more non-vertical orientations. For example, in the alternative embodiment of FIGS. 1E and 2E, the non-planar structures 276 are loft portions that are knitted in quilt-like pattern.

The cushion region of the knitted component may be knitted from a variety of materials. Given that the cushion region is located where it is likely to contact a wearer's foot when the knitted component is incorporated into an article of footwear, it may be desirable to knit at least part of the non-planar structures with one or more materials having a relatively soft hand. It may also be desirable to knit at least part of the non-planar structures from relatively durable yarns that will withstand repeated ingress and egress of a wearer's foot into an article of footwear and constant friction forces without degradation. Such yarns may exhibit a minimum tensile strength, for example approximately 0.2 kgf, 0.3 kgf, 0.4 kgf, 0.5 kgf, or greater tensile strength. The yarns may also have a minimum tenacity, for example approximately 2 g/denier, 3 g/denier, 4 g/denier, 5 g/denier, 6 g/denier, or greater tenacity. For example, the non-planar structures may be knitted from one or more synthetic yarns formed at least partially from polyester (e.g., yarns having at least 70%, 75%, 80%, 85%, 90%, 95%, or greater polyester content). Because the cushion region may exhibit better performance if it conforms better to a wearer's foot, it may be desirable to knit at least part of the cushion region from one or more elasticized yarns, which may impart resiliency to the knit structure. For example, at least some non-planar structures and/or base portions may be knitted from yarns having elastane fibers that comprise at least 2%, 3%, 5%, 10%, or greater portion of the yarn, such that the yarn can achieve at least approximately 15%, 20%, 25% or greater elongation without breaking. For example, base portions located adjacent the heel centerline may include yarns having elastane fibers to improve the conformance of the cushion region to a wearer's foot.

In any of the embodiments described herein, it may be desirable to knit part or substantially all of the knitted component (including any cushion region) from recyclable materials, e.g., thermoplastic polymer materials that may be melted and re-formed. Given this, the cushion region may be formed with alternative yarns that substantially comprise recyclable materials that exhibit similar physical properties as described above. For example, the knitted component may include yarns formed of at least one thermoplastic polymer material or material composition (e.g., at least one polyurethane, polyamide, polyolefin, and/or nylon) that transitions from a solid state to a softened or liquid state when subjected to certain temperatures at or above its melting point and then transitions back to the solid state when cooled. For example, at least a portion, at least half, a majority, or substantially all of the knitted component may include a first thermoplastic polymer. As one non-limiting example, at least 90%, 93.5%, or greater percentage of the weight of the knitted component may include the resin that makes up the first thermoplastic polymer.

The foregoing uppers may include one or more optional tension zones that help the cushion region retain a wearer's foot when the knitted component is incorporated into an article of footwear. More specifically, the tension zone may form part of the same integrally-knit knitted component as the cushion region, and therefore may be connected with the cushion region through one or more courses of yarn. The tension zone may include one or more elasticated yarns as described above, which may facilitate the ingress and egress of a wearer's foot when the knitted component is incorporated into an article of footwear by elongating slightly under tensile loads. The tension zone may be located near the cushion region on a lateral or medial side of the knitted component. For example, the knitted component 34 of FIG. 1A includes first and second tension zones 72, 74 in a lateral collar region 76 and a medial collar region 78, respectively. In other embodiments, the tension zone(s) may be additionally or alternatively located in a lateral or medial ankle region, or a sub-ankle region. For example, the knitted component 100 of FIG. 1B includes first and second tension zones 136, 138 located in lateral and medial sub-ankle regions 140, 142, respectively. In other embodiments, the tension zone(s) may extend toward or to an outer edge of the knitted component, and may also extend toward or to a collar edge.

When the knitted component is incorporated into an article of footwear and when a wearer inserts a foot into the article, the yarns in the tension zone may experience a tension force. Because interlooped courses of yarn connect the cushion region and the tension zone, the tensile force experienced in the tension zone may pull the cushion region forward, thereby causing the cushion region to conform to the wearer's heel. This anatomical conformance may help secure the wearer's foot during ambulatory activities such as walking, running, and athletics.

The knitted components and uppers described herein may be incorporated into articles of footwear. FIGS. 5A-D illustrate an article of footwear 500 that includes an upper 504 that is at least partially formed from a knitted component 508. As shown, the upper 504 may be secured to at least one sole structure 512. The article 500 is disclosed as having a general configuration suitable for walking, running, athletics, and other ambulatory activities. Concepts associated with footwear, including the upper 504 and knitted component 508, may also be applied to a variety of other athletic footwear types, including but not limited to baseball shoes, basketball shoes, cross-training shoes, cycling shoes, football shoes, soccer shoes, sprinting shoes, tennis shoes, and hiking boots. The concepts may also be applied to footwear types that are generally considered to be non-athletic, including dress shoes, loafers, sandals, and work boots. The concepts disclosed herein apply, therefore, to a wide variety of footwear types. Furthermore, the concepts disclosed herein may apply to articles beyond footwear, such as accessories or apparel.

As shown in FIGS. 5A-D, the upper 504 may generally provide a comfortable and secure covering for a foot of a wearer. As such, the wearer may insert a foot through an opening 516 formed in the upper 504 and into a void to effectively secure the foot within the article 500 or otherwise unite the foot and article 500. The opening 516 is bordered by a collar 524. Moreover, the sole structure 512 may be secured to a lower area of the upper 504 and extend between the foot and the ground to cushion the foot, provide traction, enhance stability, and influence the motions of the foot.

As with the uppers and knitted components described above, articles of footwear may generally be divided into three general regions: a forefoot region, a midfoot region, and a rearfoot region. Referring still to FIGS. 5A-D, a rearfoot region 528 may secure the wearer's heel within the article 500 and may also protect the wearer's heel from abrasion and shock. The rearfoot region 528 of the article 500 may include components of the upper 504 (including the knitted component 508) and the sole structure 512, and may additionally interact with other systems within the article 500 (e.g., a tension system and/or a closure system) to improve functionality and performance. Notably, the rearfoot region 528 need not be visually distinct from a midfoot region 532 (for example, distinguished by an edge, seam, or other structure). Rather, the two regions 528 and 532 may continuously transition, as through a common and continuous knit structure formed during a single knitting process.

Referring still to FIG. 5A-D, the rearfoot region 528 may extend from a medial border region 536, around a heel portion 540, to a lateral border region 544. Additionally, the rearfoot region 528 may extend upward to the 516 opening and collar 524, and may extend downward to the ground, encompassing all structure present in that space, including portions of the upper 504 and the sole structure 512. Additionally, the rearfoot region 528 of the article 500 may include more than one layer of material, for example an interior knit layer of the knitted component 508 that is configured to face a wearer's foot, and an exterior knit layer of the knitted component 508 that faces outward from the void. In such cases, the layers may, but need not be, physically separable. The rearfoot region 528 may further include other components, such as components positioned between knit layers of the upper 504 to provide cushioning.

Figure 5A:
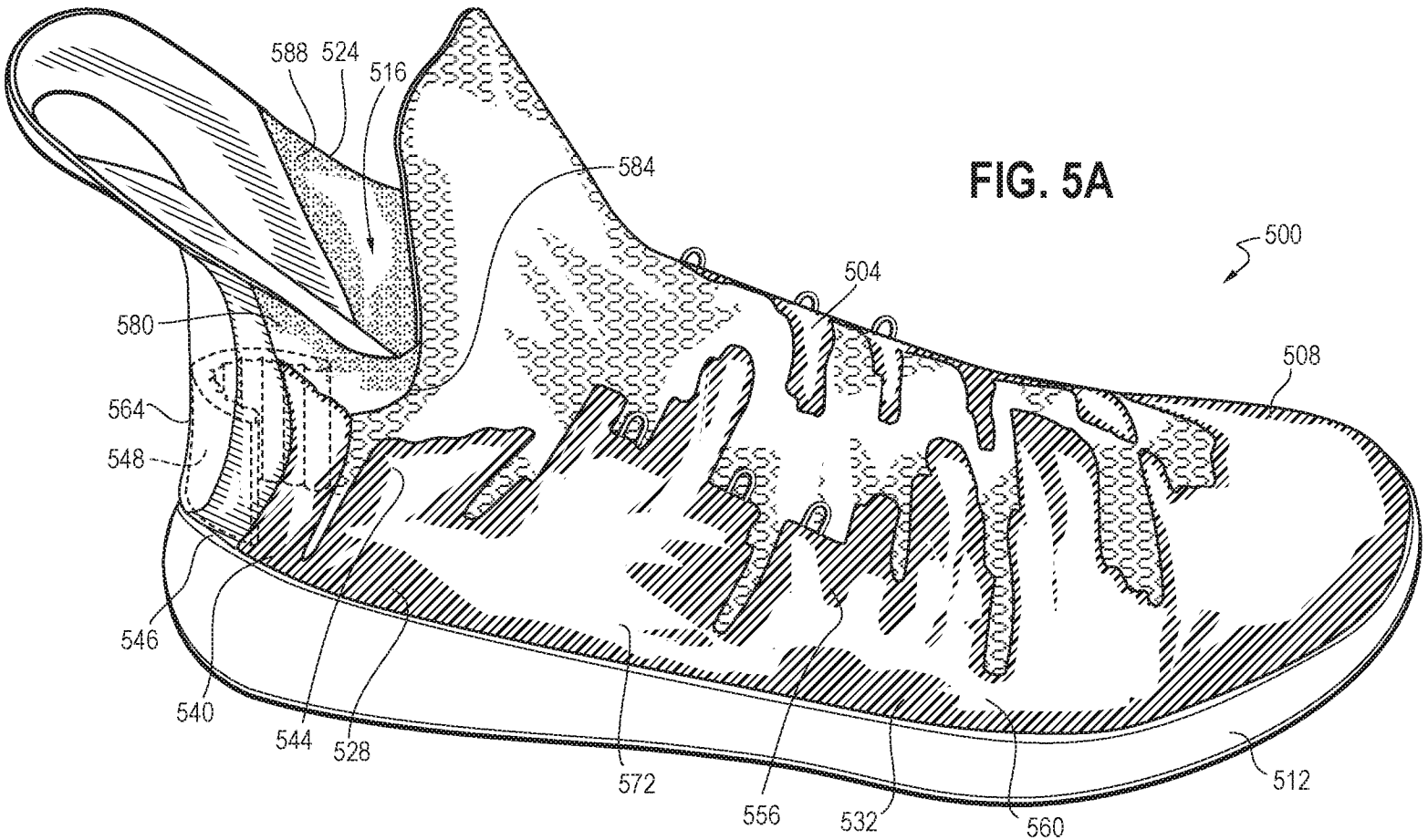
FIG. 5A shows a lateral perspective view of an article of footwear according to one aspect.
Figure 5B:
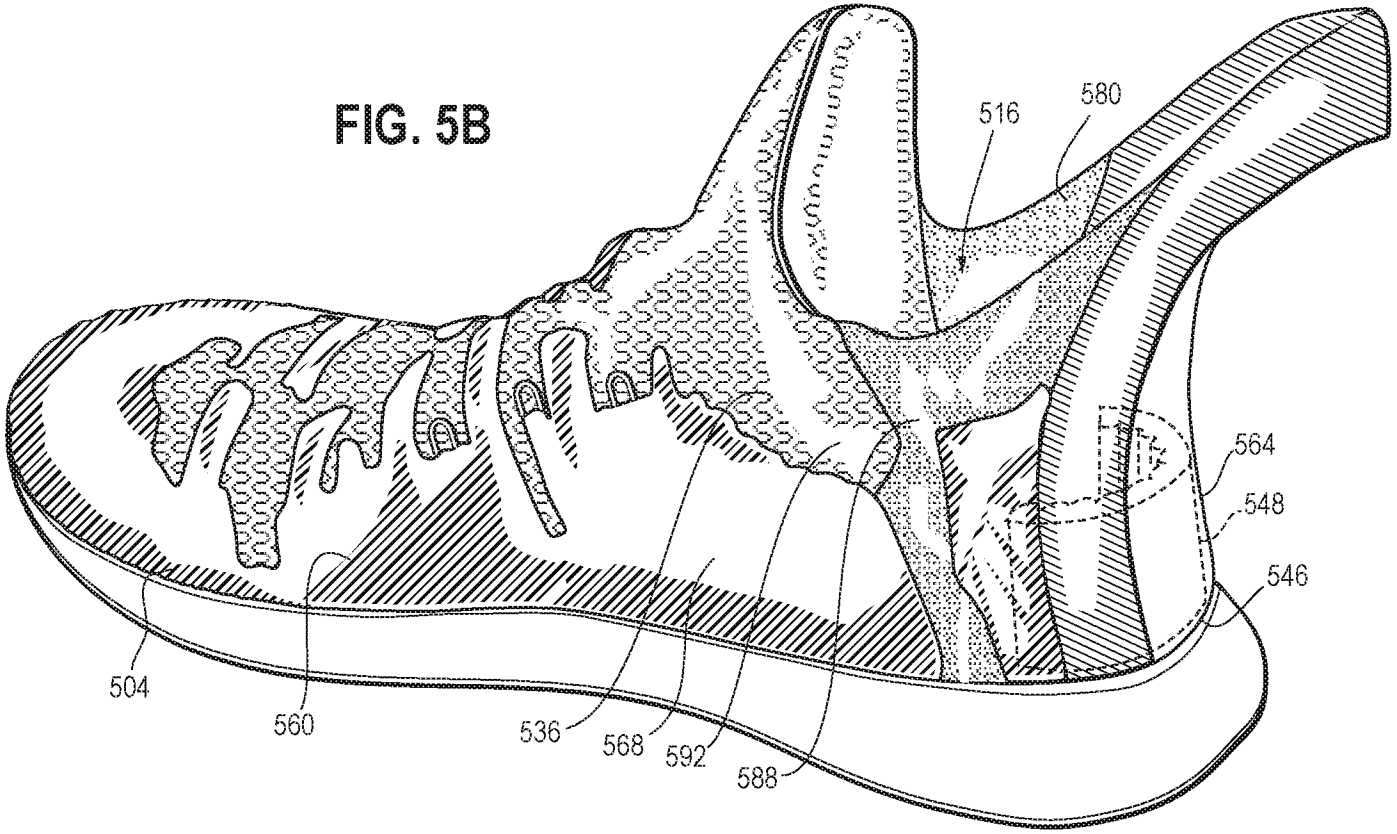
FIG. 5B shows a medial perspective view of the article of footwear of FIG. 5A.
Figure 5D:
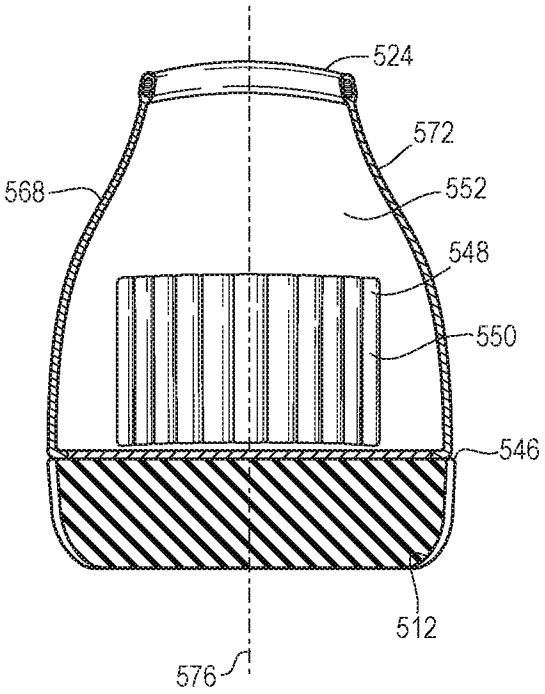
FIG. 5D shows a front section view of the article of footwear of FIG. 5A.
Figure 5C:
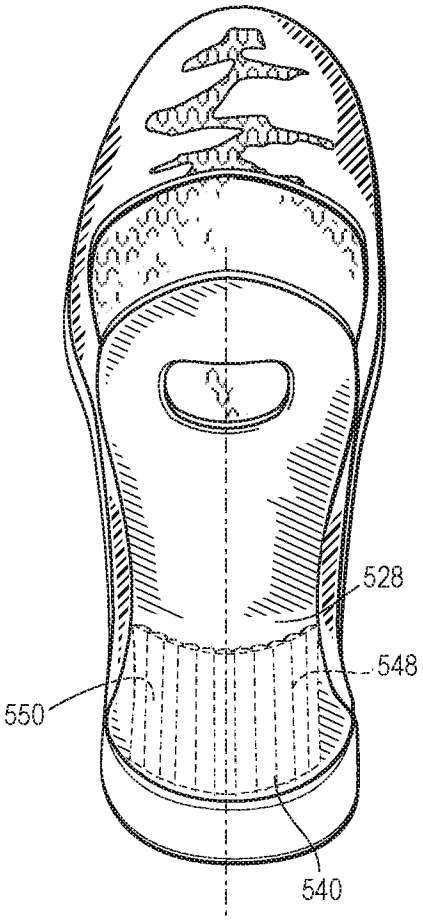
FIG. 5C shows a rear view of the article of footwear of FIG. 5A.

Referring still to FIG. 5A-C, along with the section view of FIG. 5D, the rearfoot region 528 of the article 500 includes a rectangular cushion region 548 having a plurality of non-planar structures 550 that are integrally knitted with the knitted component 508 and projects away from an interior surface 552 of the knitted component 508 and into the void. The knitted component 508 also includes knitted non-planar structures 556 on an exterior surface 560. In this embodiment, the knitted non-planar structures 556 resemble a cage, although this is merely exemplary and the exterior surface of other knitted components could have different structures and appearances. However the embodiment of FIGS. 5A-D illustrates that the knitted component 508 may include integrally knitted non-planar structures on both the interior and exterior surfaces 552, 560. The cushion region 548 is located in a calcaneus region 564 and wraps forward along a medial side 568 and a lateral side 572 of the upper 504. With reference to the section view of FIG. 5D, the plurality of non-planar structures 550 are knitted in a vertical orientation, i.e., parallel to a heel centerline 576 of the article 500. In this embodiment, the cushion region 548 begins at a bite line 546, although in other embodiments, the cushion region may begin within 5 mm, 10 mm, 20 mm, 30 mm, 40 mm, 50 mm or greater distance from a bite line. The cushion region 548 has a vertical height (i.e., in the direction of the heel centerline 576) of approximately 20 mm-40 mm, and a width of approximately 60 mm-90 mm, although the dimensions of alternative embodiments may differ as discussed above with respect to knitted components. The article 500 also includes a first tension zone 580 located a lateral collar region 584 and a second tension zone 588 located in a medial collar region 592, both tension zones 580, 592 being at least partially formed from elasticated yarns to impart stretch to the knitted component 508 and also to pull the cushion region 548 against a wearer's heel.

Figure 6A:
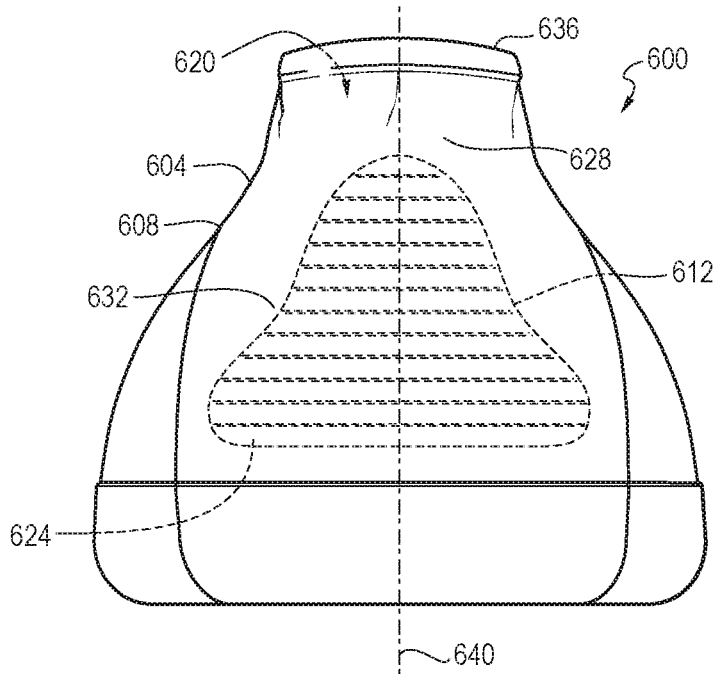
FIG. 6A shows a rear view of an article of footwear according to another aspect.
Figure 6B:
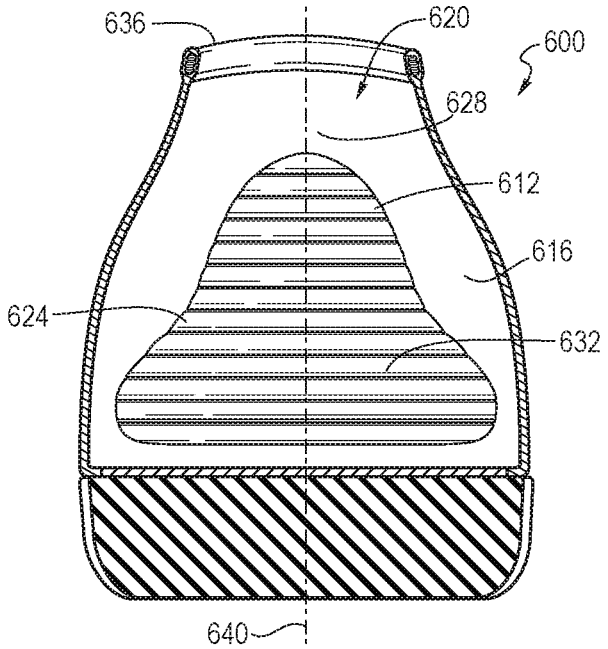
FIG. 6B shows a front section view of the article of footwear of FIG. 6A.

In the alternative article of footwear 600 of FIGS. 6A-6B, an upper 604 includes a knitted component 608 having an ergonomic, non-geometrically shaped cushion region 612 that extends away from an internal surface 616 of the knitted component 608 in a void 620 formed by the upper 604. The cushion region 612 includes a plurality of non-planar structures 624 comprising ottomans. In this embodiment, the upper 604 extends high into an Achilles region 628. The cushion region 612 is located in a calcaneus region 632 and extends into the Achilles region 628 toward a collar edge 636. With reference to the section view of FIG. 6B, the non-planar structures 624 are knitted with a horizontal orientation, i.e., perpendicular to a heel centerline 640.

Figure 7A:
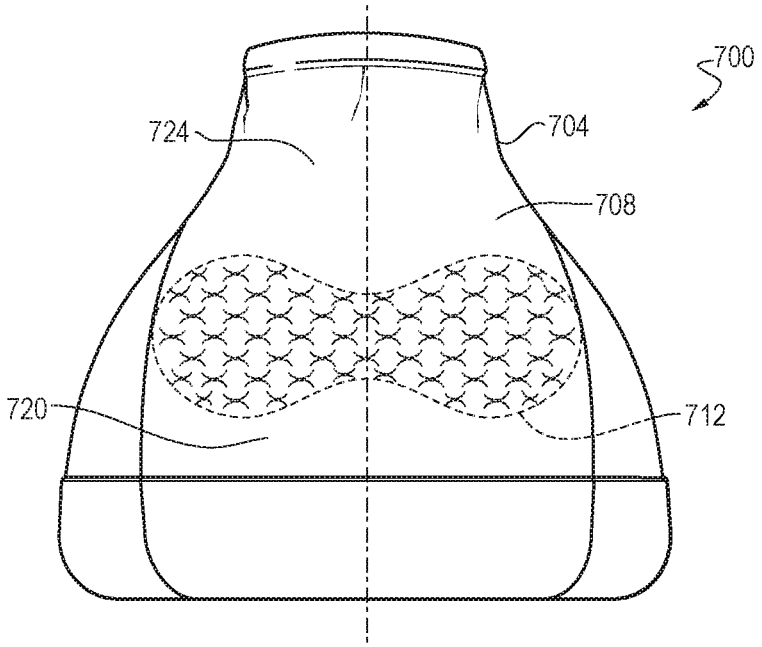
FIG. 7A shows a rear view of an article of footwear according to another aspect.
Figure 7B:
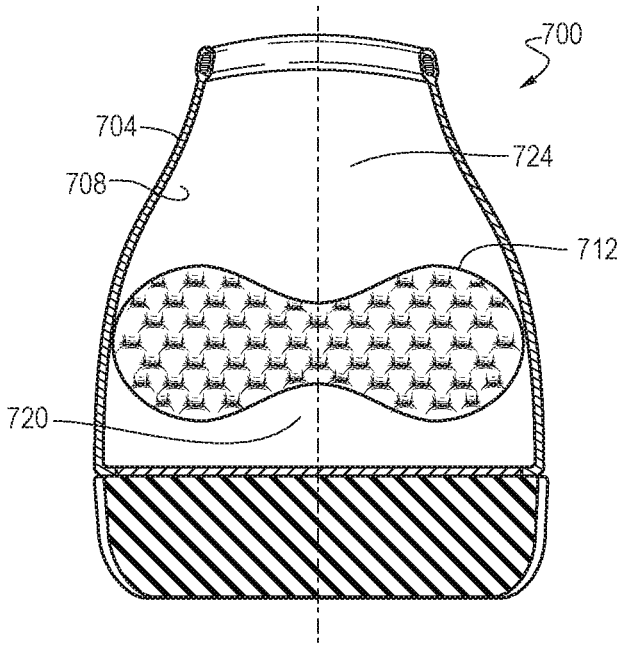
FIG. 7B shows a front section view of the article of footwear of FIG. 7A.

In the alternative embodiment of FIGS. 7A-7B, an article of footwear 700 includes an upper 704 at least partially formed from a knitted component 708. The knitted component 708 includes an ergonomic, non-geometrically shaped cushion region 712 that includes a plurality of non-planar structures 716 formed as loft portions. The cushion region 712 is located in a calcaneus region 720, but does not extend into an Achilles region 724. The non-planar structures 716 are knitted in a quilted pattern in order to improve conformity with the wearer's heel.

Figure 8:
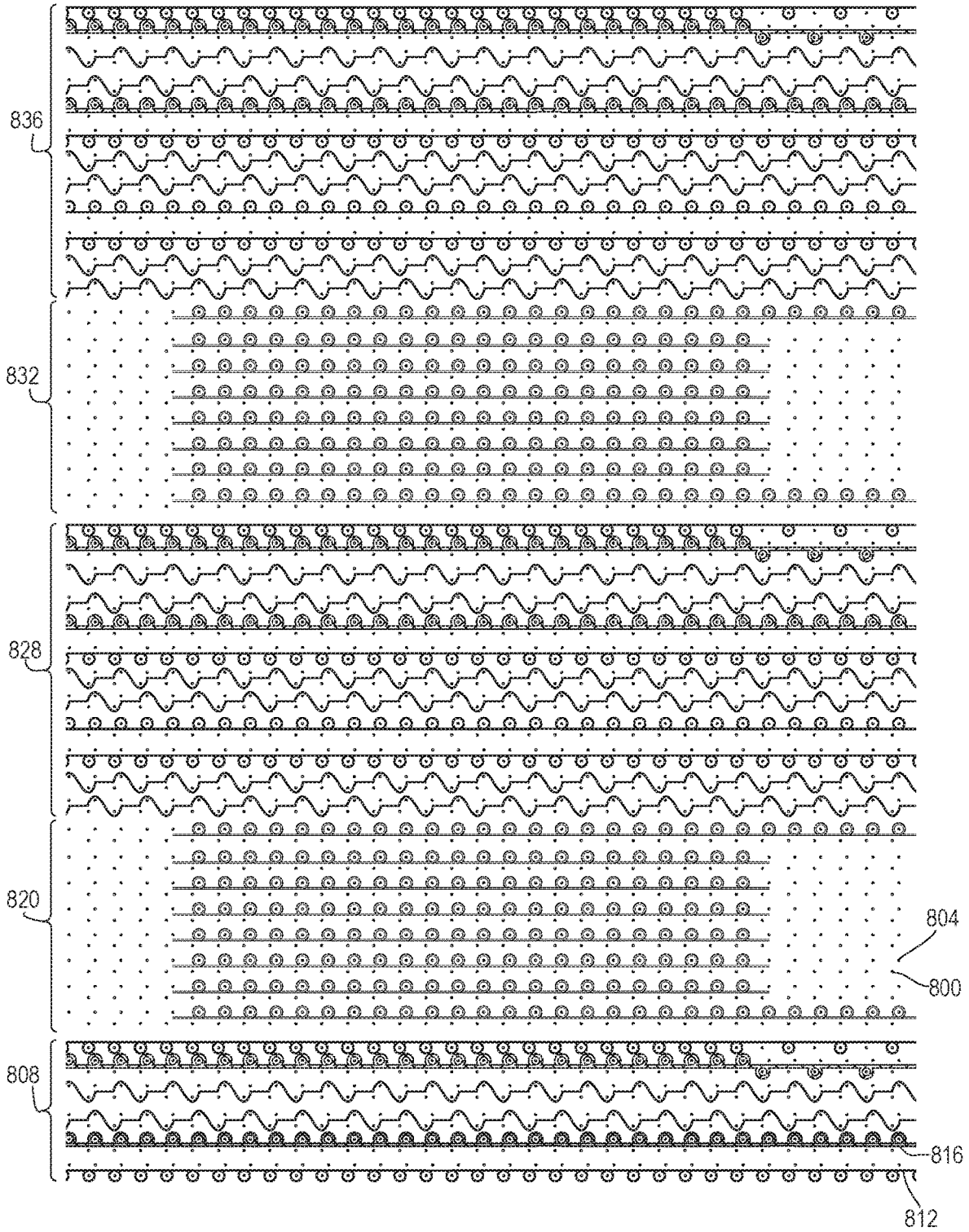
FIG. 8 shows a knitting sequence according to one aspect.

FIG. 8 illustrates a non-limiting knitting sequence that may be utilized to form knitted components (such as for an upper for an article of footwear) having a first surface and an opposite-facing second surface, and an integrally-knitted cushion region as described above. The knitted component may be formed through a weft knitting process (e.g., with a flat knitting machine with one, two, or more needle beds). The sequence of FIG. 8 is illustrated on a weft knitting machine having a first needle bed 800 and a second needle bed 804.

In a first step 808, the knitting machine knits a base portion of a cushion region. More specifically, the knitting machine knits courses of a first yarn 812 and a second yarn 816 on the first and second needle beds 800, 804 in order to form a relatively strong knitted area. The number of courses knitted in the first step 808 generally correlates with the width of a base portion of the cushion region. In other words, knitting a greater number of courses in the first step 808 would create a base portion having a greater width, and vice versa. Although some courses of the first yarn 812 utilize tuck stitches in FIG. 8, other embodiments may utilize different knit structures in this step, e.g., a double jersey or a rib knit structure. The first step 808 includes a course of the second yarn 816 on the second needle bed 804 in preparation for the next step, in which the knitting machine knits a non-planar structure. The knitting machine then knits a course of the first yarn 812 on the first needle bed 800. The first and second yarns 812, 816 may be the same or different. For example, the first and second yarns 812, 816 may include one or more non-elasticated yarns having a tensile strength of at least approximately 0.2 kgf, 0.3 kgf, 0.4 kgf, 0.5 kgf, or greater tensile strength, and which may include at least 70%, 75%, 80%, 85%, 90%, 95% or greater percentage (by weight) of a particular base chemistry. Alternatively, the first and/or second yarns 812, 816 may include elasticated yarns in order to impart stretch and resiliency to the knitted component.

In a second step 820, the knitting machine knits a portion of a non-planar structure of the cushion region, the non-planar structure extending away from a second surface of the knitted component. More particularly, the knitting machine knits a plurality of partial courses of a third yarn 824 on the second needle bed 804. The knitting length of the partial courses may generally correspond to one dimension of the resulting non-planar structure, e.g., the height (if the courses are eventually oriented parallel to a heel centerline of an upper). For example, the partial courses of the second step 820 have a knitting length of approximately twenty-two needles. In other embodiments, knitting partial courses with a shorter knitting length (e.g., fewer than twenty-two needles) would produce a non-planar structure with a shorter height. The number of partial courses knitted in the second step 820 may correspond with the depth by which the resulting non-planar structure extends away from the second surface of the knitted component. In other words, a greater number of courses knitted in the second step 820 may create a non-planar structure that has a greater depth, i.e., extends further away from the inner surface of the knitted component. For example, the second step 820 of FIG. 8 includes eight courses of the second yarn, which may produce a non-planar structure that extends away from a base portion by approximately 2 mm-5 mm depending on the yarn selection. The converse is also true, i.e., a fewer number of courses knitted in the second step 820 would create a non-planar structure having a lesser depth, all else equal. The third yarn 824 may be formed from the same or different materials as the first and second yarns 812, 816.

In a third step 828, the knitting machine knits a plurality of additional courses of the first yarn 812 on the first and second needle beds 800, 804, although the number of courses may vary in different embodiments. More specifically, in the third step 828, the knitting machine closes the non-planar structure knitted during the second step 820 and knits another base portion by knitting additional courses of the first and second yarns 812, 816 utilizing a combination of single-bed and double-bed knit structures. Additionally, the knitting machine knits at least one course of the second yarn 816 on the second needle bed in preparation to knit the next non-planar structure.

Following the first through third steps 808, 820, 828, the foregoing sequence may be repeated as desired in order to form additional non-planar structures and base portions, i.e., to expand the cushion region. For example, in a fourth step 832, the knitting machine forms another non-planar structure from the third yarn 824 as described above with respect to the second step 820. In a fifth step 836, the knitting machine completes the non-planar structure knitted in the fourth step 832, similar to the third step 828 described above.

Figure 9:
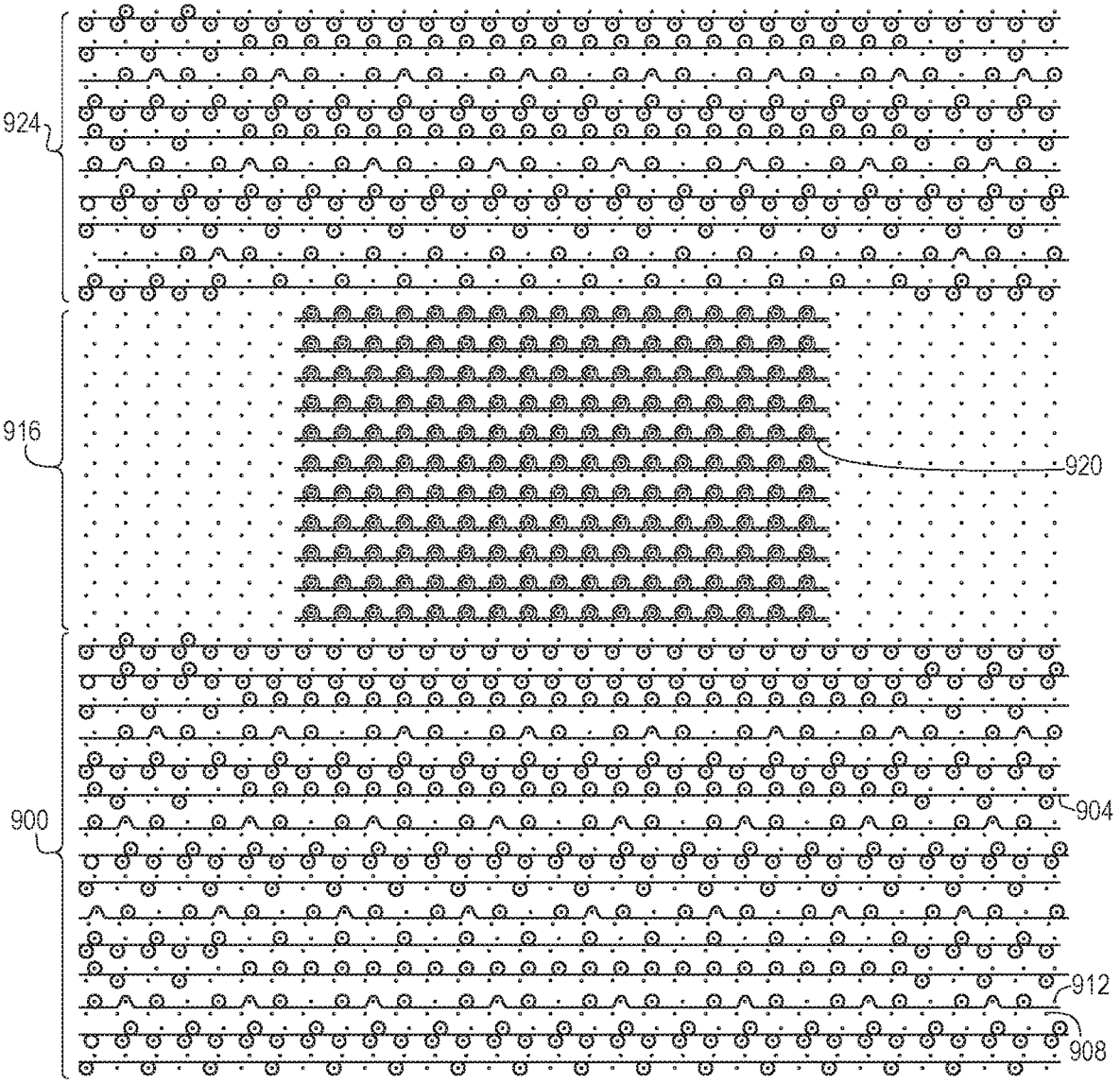
FIG. 9 shows a knitting sequence according to another aspect.

FIG. 9 illustrates another non-limiting knitting sequence that may be utilized to form knitted components (such as for an upper for an article of footwear) having an integrally-knitted cushion region. The resulting knitted component may have a different visual appearance and physical properties (e.g., a different stretch level) than the knitted component produced by the knitting sequence of FIG. 8.

In a first step 900, the knitting machine forms a base portion comprising fifteen courses by knitting a plurality of courses of a first yarn 904 on a first needle bed 908. With fifteen courses, the base portion knitted by the first step 900 of FIG. 9 has a greater width than the twelve-course base portion knitted by the third step 828 of FIG. 8, all else equal. The first yarn 904 may include an elasticated yarn as described above, for example yarns having elastane fibers that comprise at least 2%, 3%, 5%, 10%, or greater portion of the yarn, such that the yarn can achieve at least approximately 15%, 20%, 25%, or greater elongation without breaking. The courses of the first yarn 904 may include a plurality of interlocking courses knitted on the first needle bed 908 and a second needle bed 912, which may help impart stretchiness to the knitted component.

In a second step 916, the knitting machine knits a portion of a non-planar structure of the cushion region that extends away from a second surface of the knitted component. More particularly, the knitting machine knits eleven partial courses of a second yarn 920 on the second needle bed 912. With eleven courses, the non-planar structure knitted by the second step 916 of FIG. 9 will project further away from the surface of the knitted component as compared to the non-planar structure knitted by the second step 820 of FIG. 8, all else equal. Furthermore, each partial course of the second yarn 920 has a knitting length of seventeen needles. As a result, the non-planar structure knitted by the second step 916 of FIG. 9 will have a shorter height than the twenty-two needle non-planar structure knitted by the second step 820 of FIG. 8, all else equal. The second yarn 920 may be formed from the same or different materials as the first yarn 904.

In a third step 924, the knitting machine closes the non-planar structure knitted during the second step 916 and forms a second base portion from the first yarn 904, similar to the first step 900. Following the third step, 924 the foregoing sequence may be repeated as necessary to form additional non-planar structures and base portions, i.e., to expand the knitted cushion region.

In use, uppers for articles of footwear that incorporate a knitted component having an integrally knitted cushion region as described above in the rearfoot region may exhibit a number of advantages. For example, such knitted components may improve the fit of the article of footwear by ensuring a close and conforming fit with the wearer's heel. The cushion region may also prevent the wearer's foot from slipping out of the article of footwear. Additionally, in some embodiments, the cushion region may obviate the need for traditional heel counters and other components when the knitted component is incorporated into an article of footwear, thereby reducing weight and cost. In some embodiments, the cushion region may be formed from one or more materials that are similar or identical to other materials utilized in the knitted component, thereby improving recyclability of the knitted component.

While various embodiments of the present disclosure have been described, the present disclosure is not to be restricted except in light of the attached claims and their equivalents. Rather, the embodiments discussed were chosen and described to provide the best illustration of the principles of the present disclosure and its practical application to thereby enable one of ordinary skill in the art to utilize the present disclosure in various forms and with various modifications as are suited to the particular use contemplated. It is intended and will be appreciated that embodiments may be variously combined or separated without departing from the present disclosure and all exemplary features described herein are applicable to all aspects of the present disclosure described herein. Moreover, the advantages described herein are not necessarily the only advantages of the present disclosure and it is not necessarily expected that every embodiment of the present disclosure will achieve all of the advantages described.

We claim:

1. An upper, comprising:

a knitted component having an exterior surface and an interior surface, wherein the knitted component comprises a cushion region integrally knitted with the knitted component;

wherein the cushion region comprises a plurality of non-planar structures that each project away from the interior surface of the knitted component to a greater extent than the non-planar structures within the plurality of non-planar structures project away from the exterior surface of the knitted component, each non-planar structure projecting away from the interior surface by at least 1 mm;

wherein the cushion region is located in a rearfoot region of the upper.

2. The upper of claim 1, wherein the cushion region is at least partially located in a calcaneus region.

3. The upper of claim 1, wherein the cushion region is at least partially located in an Achilles region.

4. The upper of claim 1, wherein the cushion region has a shape with an area of at least 1,000 $mm^2$.

5. The upper of claim 1, wherein the cushion region has a geometric shape.

6. The upper of claim 1, wherein the cushion region has a non-geometric shape.

7. The upper of claim 1, wherein the plurality of non-planar structures are separated by a plurality of base portions.

8. The upper of claim 7, wherein the plurality of base portions are at least partially formed from an elasticated yarn.

9. The upper of claim 1, wherein the plurality of non-planar structures comprises tubular knit structures.

10. The upper of claim 9, wherein the plurality of non-planar structures have an orientation parallel to a heel centerline of the upper.

11. The upper of claim 1, wherein the plurality of non-planar structures comprises loft portions on the interior surface of the knitted component, each loft portion being positioned opposite a planar portion of the exterior surface of the knitted component.

12. The upper of claim 1, wherein the plurality of non-planar structures comprises at least five non-planar structures.

13. The upper of claim 1, wherein a thermoplastic polymer material comprises at least 93.5% of the weight of the knitted component.

14. The upper of claim 13, wherein the thermoplastic polymer material is a thermoplastic polyurethane.

15. The upper of claim 1, further comprising a second plurality of knitted elements that project from the exterior surface.

16. An article of footwear, comprising:

an upper associated with a sole structure, the upper forming a void, the upper comprising an interior surface facing the void and an opposite-facing exterior surface, wherein the upper comprises a cushion region that is integrally knitted with a knitted component of the upper, wherein the cushion region comprises a plurality of non-planar structures that each project away from the interior surface into the void and are configured to contact a wearer's heel, each non-planar structure projecting from the interior surface to a greater extent than the non-planar structures within the plurality of non-planar structures project away from the opposite-facing exterior surface.

17. The article of footwear of claim 16, wherein the cushion region begins at or within 5 mm of a bite line where the upper meets the sole structure.

18. The article of footwear of claim 16, wherein the upper comprises a tension zone configured to pull the cushion region against the wearer's heel.

19. The article of footwear of claim 18, wherein the tension zone is located adjacent to a collar region of the upper.

20. The article of footwear of claim 18, wherein the tension zone is located in a sub-ankle region of the upper.

* * * * *